US011242669B2

(12) United States Patent
Lee et al.

(10) Patent No.: US 11,242,669 B2
(45) Date of Patent: Feb. 8, 2022

(54) SYSTEMS AND METHODS FOR CONTROLLING MACHINE GROUND PRESSURE AND TIPPING

(71) Applicant: JOY GLOBAL SURFACE MINING INC, Milwaukee, WI (US)

(72) Inventors: MooYoung Lee, Glendale, WI (US); William J. Hren, Wauwatosa, WI (US); Ethan J. Pedretti, Holmen, WI (US); Michael J. Linstroth, Port Washington, WI (US); Nicholas R. Voelz, West Allis, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 649 days.

(21) Appl. No.: 15/751,035

(22) PCT Filed: Jun. 30, 2016

(86) PCT No.: PCT/US2016/040432
§ 371 (c)(1),
(2) Date: Feb. 7, 2018

(87) PCT Pub. No.: WO2017/004389
PCT Pub. Date: Jan. 5, 2017

(65) Prior Publication Data

US 2018/0230673 A1 Aug. 16, 2018

Related U.S. Application Data

(60) Provisional application No. 62/186,969, filed on Jun. 30, 2015.

(51) Int. Cl.
*E02F 3/43* (2006.01)
*E02F 3/30* (2006.01)
(Continued)

(52) U.S. Cl.
CPC ..... *E02F 3/439* (2013.01); *E02F 3/308* (2013.01); *E02F 3/427* (2013.01); *E02F 9/2033* (2013.01);
(Continued)

(58) Field of Classification Search
CPC . E02F 3/439; E02F 3/308; E02F 3/427; E02F 9/2033; E02F 9/24; E02F 9/262;
(Continued)

(56) References Cited

U.S. PATENT DOCUMENTS

2006/0123673 A1 6/2006 Glover
2008/0275610 A1 11/2008 Terashima et al.
(Continued)

FOREIGN PATENT DOCUMENTS

CN 102145716 A 8/2011
CN 103569871 A 2/2014
(Continued)

OTHER PUBLICATIONS

Chilean Patent Office Action for Application No. 2017-03434 dated Apr. 15, 2019 (6 pages).
(Continued)

*Primary Examiner* — Paula L Schneider
(74) *Attorney, Agent, or Firm* — Michael Best & Friedrich LLP

(57) ABSTRACT

Methods and systems for operating an industrial machine. One system includes a controller that includes an electronic processor. The electronic processor is configured to calculate an eccentricity of a center of gravity of the industrial machine with respect to a center of a bearing propelling the industrial machine and calculate a ground pressure associated with the bearing based on the eccentricity of the center of gravity. The electronic processor is also configured to set a maximum torque applied by an actuator included in the
(Continued)

industrial machine to a value less than an available maximum torque based on the eccentricity of the center of gravity and the ground pressure.

21 Claims, 18 Drawing Sheets

(51) Int. Cl.
*E02F 9/20* (2006.01)
*E02F 9/24* (2006.01)
*E02F 9/26* (2006.01)
*E02F 3/42* (2006.01)
*E02F 9/02* (2006.01)

(52) U.S. Cl.
CPC ..... *E02F 9/24* (2013.01); *E02F 9/262* (2013.01); *E02F 9/265* (2013.01); *E02F 3/301* (2013.01); *E02F 9/02* (2013.01)

(58) Field of Classification Search
CPC ... E02F 9/265; E02F 3/301; E02F 9/02; E02F 3/4398; E02F 3/808
USPC ..... 701/50
See application file for complete search history.

(56) References Cited

U.S. PATENT DOCUMENTS

2008/0282583 A1* 11/2008 Koellner ..... E02F 9/264 37/348
2010/0324788 A1* 12/2010 Toda ..... F16D 15/00 701/50
2012/0277959 A1* 11/2012 Colwell ..... E02F 3/304 701/50
2014/0330489 A1 11/2014 Sakamoto et al.
2015/0204052 A1* 7/2015 Lee ..... E02F 3/304 701/50

FOREIGN PATENT DOCUMENTS

CN 103569883 * 2/2014 ..... B66C 23/88
CN 104110048 A 10/2014
JP 2012062653 A 3/2012

OTHER PUBLICATIONS

Examination Report issued by the Chile Patent Office for related Application No. 201703434 dated Dec. 13, 2018 (7 pages including Statement of Relevance).
Ben She.Yi Ming, "Foundation Engineering," Chongqing University Press, 2nd Edition, Feb. 1, 2005, pp. 30.
Examination Report No. 1 issued by the Australian Government for Application No. 2016288672 dated Sep. 8, 2020 (4 pages).
Office Action issued by the China National Intellectual Property Administration for Application No. 201680049216.4 dated Aug. 12, 2020 (13 pages including English summary).
Australian Patent Office Examination Report No. 2 for Application No. 2016288672 dated Jun. 28, 2021 (3 pages).

* cited by examiner

SYSTEMS AND METHODS FOR CONTROLLING MACHINE GROUND PRESSURE AND TIPPING

RELATED APPLICATIONS

This application claims priority to U.S. Provisional Patent Application No. 62/186,969, filed on Jun. 30, 2015, the entire contents of which are incorporated herein by reference.

BACKGROUND

Embodiments of the invention relate to controlling an industrial machine, such as a mining shovel, to prevent machine tipping.

During operation, industrial machines, such as mining shovels, can move back and forth (for example, during digging and loading operations). This movement can affect the center of gravity or eccentricity of the machine of the machine. Machine eccentricity is defined as the movement of the center of gravity of the machine from the nominal position as a result of operation practices or conditions. Depending on the extent of the eccentricity of the center of gravity, portions of the mining shovel contacting the ground surface (for example, crawler shoes) may lift off the ground. A particular machine may be associated with a center of gravity and an eccentricity that the machine must stay within to prevent the machine from tipping over or to prevent certain components from being subjected to extreme forces.

The balance of an industrial machine, such as a mining shovel, can also change depending on the grade or inclination of the surface supporting the machine. For example, some shovels have an assigned "dig slope limit," which is the maximum inclination of the shovel when digging. Although shovel operators are trained to manually identify when the dig slope limit is encountered or exceeded, an operator may inadvertently try to dig on an inclination that exceeds the dig slope limit, which could cause uncontrolled or unplanned movement of the machine, inadequate control of the machine, or machine tipping.

SUMMARY

Accordingly, embodiments of the invention provide methods and systems for operating an industrial machine, such as a mining shovel to improve the stability of the industrial machine. For example, one embodiment of the invention provides a method of operating an industrial machine. The method includes calculating, with an electronic processor, an eccentricity of a center of gravity of the industrial machine. The method also includes limiting, with the electronic processor, a maximum torque applied by at least one selected from the group consisting of a hoist actuator and a crowd actuator included in the industrial machine to less than an available maximum torque based on the eccentricity of the center of gravity.

Another embodiment of the invention provides a system for operating an industrial machine. The system includes a controller that includes an electronic processor. The electronic processor is configured to calculate an eccentricity of a center of gravity of the industrial machine with respect to a center of a bearing propelling the industrial machine and calculate a ground pressure associated with the bearing based on the eccentricity of the center of gravity. The electronic processor is also configured to set a maximum torque applied by an actuator included in the industrial machine to a value less than an available maximum torque based on the eccentricity of the center of gravity and the ground pressure.

Another embodiment of the invention provides a system for operating an industrial machine. The system includes a controller that includes an electronic processor. The electronic processor is configured to determine a position of the industrial machine, and set a maximum hoist torque applied by an actuator configured to apply a hoist torque to a dipper included in the industrial machine to a value less than an available maximum hoist torque based on the position of the industrial machine.

Yet another embodiment of the invention provides a method of operating an industrial shovel. The method includes receiving, by an electronic processor, an inclinometer reading corresponding to an inclination of the shovel, comparing the inclination of the shovel to a threshold, and determining whether the inclination exceeds the threshold. When the inclination exceeds the threshold, the method includes limiting, by the electronic processor, the motion of the shovel to a second predetermined value. The method also includes comparing the inclination to a first level, and determining whether the inclination exceeds the first level. When inclination exceeds the first level, the method includes limiting, by the electronic processor, the motion of the shovel to a third predetermined value. The method further includes comparing the inclination of the shovel to a second level, and a determining whether inclination exceeds the second level. When inclination exceeds the second level, the method includes limiting, by the electronic processor, the motion of shovel to a third predetermined value.

Yet another embodiment of the invention provides a method of operating an industrial machine. The method includes determining, by an electronic processor, whether a shovel is digging over its front or over its side, and determining an inclination of the shovel. When the shovel is digging over the front, the method includes comparing, by the electronic processor, the inclination of the shovel to a first threshold, and determining whether the inclination of the shovel exceeds the first threshold. When the inclination of the shovel exceeds the first threshold, the method includes determining whether the shovel is in dig mode. When the shovel is in dig mode, the electronic processor limits the movement of the shovel. When the shovel is digging over the side, the method includes comparing, by the electronic processor, the inclination of the shovel to a second threshold, and determining whether the inclination of the shovel exceeds the second threshold. When the inclination of the shovel exceeds the second threshold, the method includes determining whether the shovel is in dig mode. When the shovel is in dig mode, the electronic processor limits the movement of the shovel.

Other aspects of the invention will become apparent by consideration of the detailed description and accompanying drawings.

DETAILED DESCRIPTION

Figure 1:
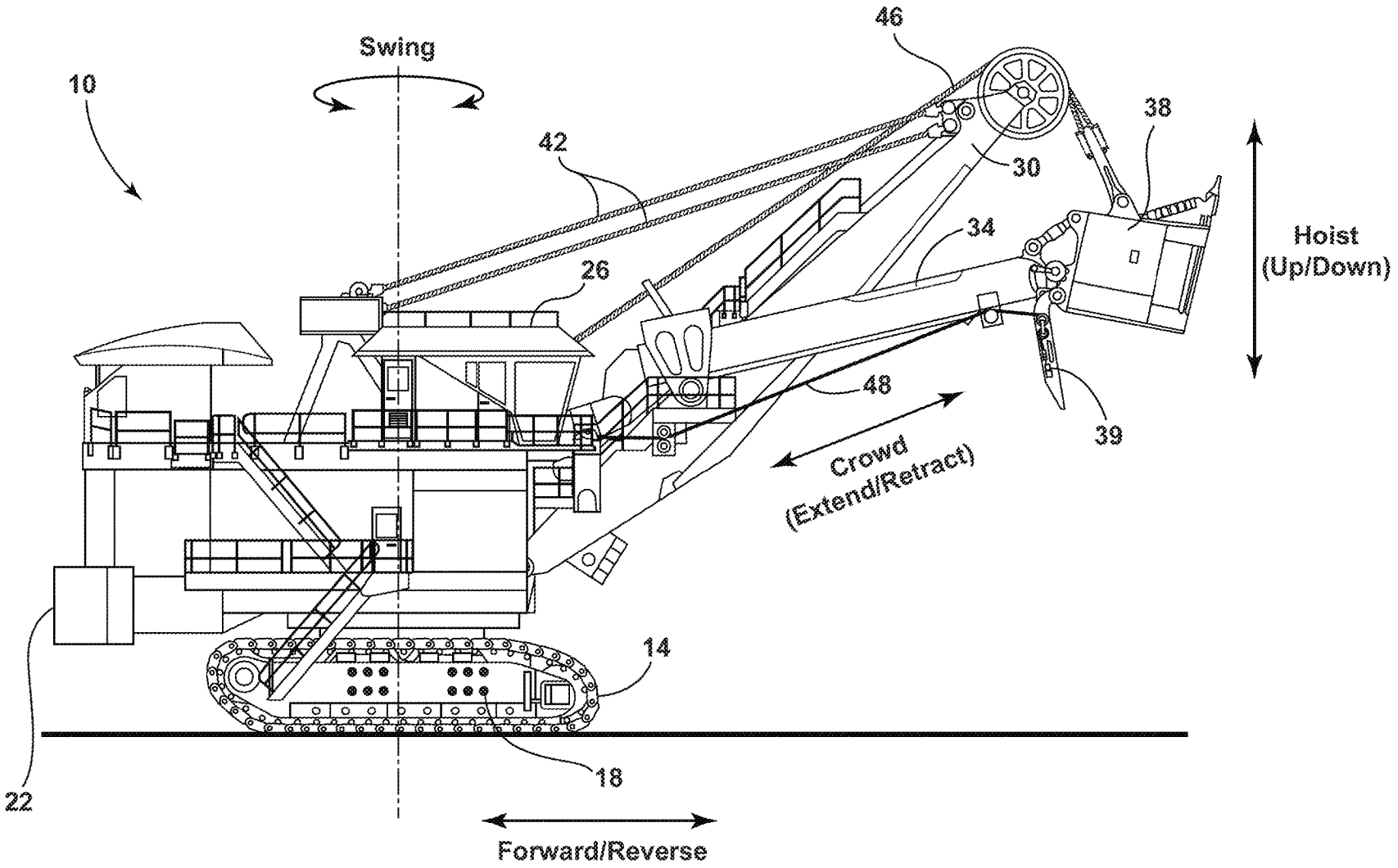
FIG. 1 illustrates a mining shovel.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, and the like.

It should be noted that a plurality of hardware and software based devices, as well as a plurality of different structural components may be utilized to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (for example, stored on non-transitory computer-readable medium) executable by one or more processors. As such, it should be noted that a plurality of hardware and software based devices, as well as a plurality of different structural components may be utilized to implement the invention. For example, "controller" and "control unit" described in the specification can include one or more processors, one or more memory modules including non-transitory computer-readable medium, one or more input/output interfaces, and various connections (for example, a system bus) connecting the components. Furthermore, and as described in subsequent paragraphs, the specific configurations illustrated in the drawings are intended to exemplify embodiments of the invention and that other alternative configurations are possible.

FIG. 1 illustrates a mining shovel 10. It should be understood that although embodiments of the invention are described herein for a mining shovel, embodiments of the invention can be applied to or used in conjunction with a variety of industrial machines (for example, a rope shovel, a dragline, AC machines, DC machines, hydraulic machines, and the like). The shovel 10 illustrated in FIG. 1 depicts an electric rope shovel according to one embodiment. The shovel 10 includes left and right crawler shoes 14 (only the left crawler shoe 14 is illustrated in FIG. 1) driven by a bearing 18 for propelling the shovel 10 forward and backward and for turning the shovel 10 (for example, by varying the speed, direction, or both of the left and right crawler shoes 14 relative to each other). The crawler shoes 14 support a base 22 including a cab 26. In some embodiments, the base 22 is able to swing or swivel about a swing axis to move, for instance, between a digging location and a dumping location. In some embodiments, movement of the crawler shoes 14 is not necessary for the swing motion.

The shovel 10 also includes a boom 30 supporting a pivotable dipper handle 34 and a dipper 38. The dipper 38 includes a door 39 for dumping contents within the dipper 38. For example, during operation, the shovel 10 dumps materials contained in dipper 38 into a dumping location, such as the bed of a haul truck, a mobile crusher, a conveyor, an area on the ground, and the like.

As illustrated in FIG. 1, the shovel 10 also includes taut suspension cables 42 coupled between the base 22 and the boom 30 for supporting the boom 30. In some embodiments, in addition to or in place of one or more of the cables 42, the shovel 10 includes one or more tension members that connect the boom 30 to the base 22. The shovel 10 also includes a hoist cable 46 attached to a winch (not shown) within the base 22 for winding the cable 46 to raise and lower the dipper 38. The shovel 10 also includes a crowd cable 48 attached to another winch (not shown) for extending and retracting the dipper handle 34. In other embodiments, in addition to or as an alternative to the crowd cable 48, the shovel 10 can include a crowd pinion and a rack for extending and retracting the dipper handle 34.

The shovel 10 also includes one or more actuators for driving or operating the dipper 38. For an electric shovel, the one or more actuators can include one or more electric motors. For example, one or more electric motors can be used to operate the hoist cable 46 and the crowd cable 48. Similarly, one or more electric motors can be used to drive the bearing 18 and swing the base 22. A hydraulic shovel can similarly include one or more hydraulic actuators operated by hydraulic fluid pressure. For example, in some embodiments, the shovel 10 includes at least one hoist actuator for raising and lowering the dipper 38 and at least one crowd actuator for extending and retracting the dipper 38.

Figure 2:
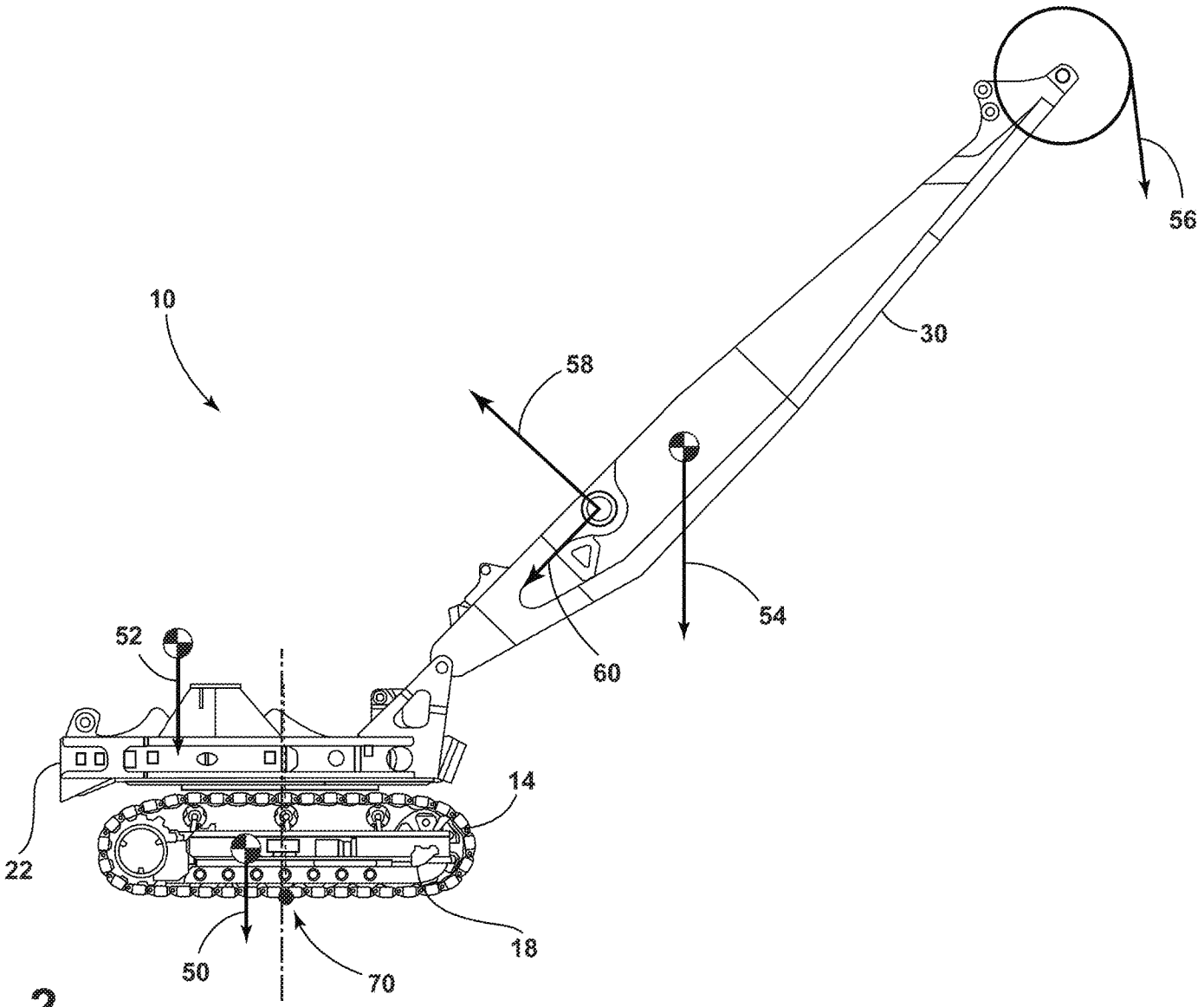
FIG. 2 schematically illustrates forces acting on the mining shovel of FIG. 1.

As illustrated in FIG. 2, various forces act on the shovel 10 during operation. In particular, the weight associated with the bearing 18 and the crawler shoes 14 (a lower body weight) provides a downward force 50 on the shovel 10. Similarly, the weight associated with the base 22 (and the cab 26) (an upper body weight) provides a downward force 52 on the shovel 10. In addition, the weight of the boom 30 provides a downward force 54 on the shovel 10.

The shovel 10 also experiences a hoisting force (also referred to as a bail pull force) 56 based on the weight of the dipper 38, the amount of material contained in the dipper 38, and the position of the dipper 38 (for example, dipper height). Similarly, the shovel 10 experiences crowd forces 58 and 60 along two axes (for example, an x axis and a y axis, respectively) that vary based on the amount of extension or retraction of the dipper handle 34. It should be understood that the forces illustrated in FIG. 2 are not provided to scale.

These forces impact the center of gravity of the shovel 10 and the eccentricity of the center of gravity from its nominal position. As the center of gravity shifts from its nominal position, the eccentricity of the machine changes. Once the eccentricity of the machine extends outside range limits for the shovel 10 (for example, specific to a particular model of the shovel 10), the machine may become unstable.

Figure 3A:
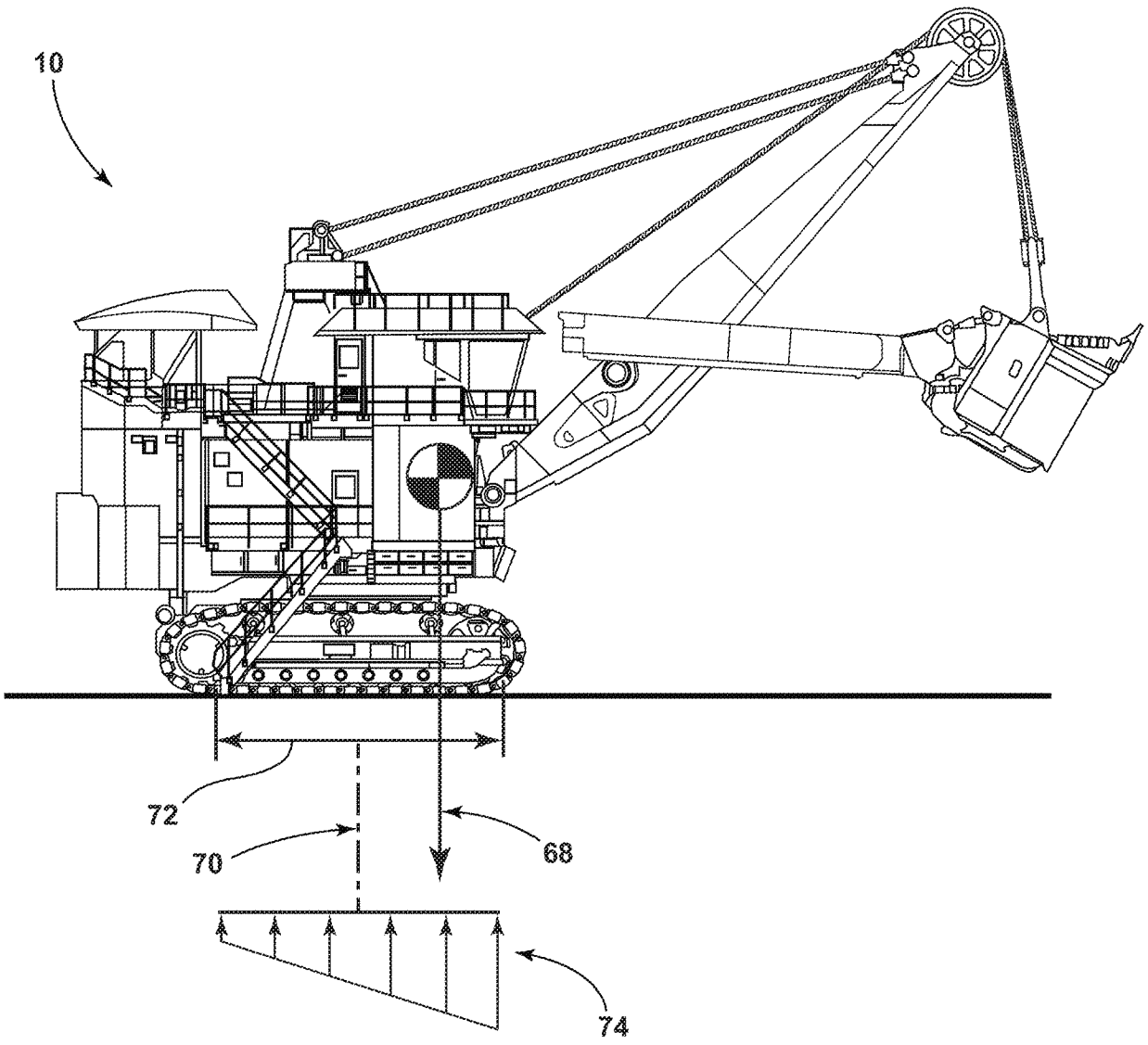
FIGS. 3A and 3B schematically illustrate an eccentricity of a center of gravity of the mining shovel of FIG. 1 in one situation.

As the eccentricity of the shovel 10 changes, the distribution of the shovel weight changes the length of contact between the shovel 10 and the ground (a ground contact length). When the contact length changes beyond a threshold, portions of the shoes 14 may no longer be in contact with the ground and the shovel 10 may become unstable. For the shovel 10, the ground contact length can be defined by the length of the bearing 18. For example, as illustrated in FIG. 3*a*, the position of a center of gravity 68 of the shovel 10 impacts distribution of ground pressure along the bearing length 72. In particular, as illustrated in FIG. 3*a*, when the dipper 38 is being raised or retracted, positive ground pressure 74 is distributed along the entire bearing length 72 in an increasing fashion from the front to the rear of the shovel 10 (a bearing loaded case, or shovel center of gravity).

Figure 3B:
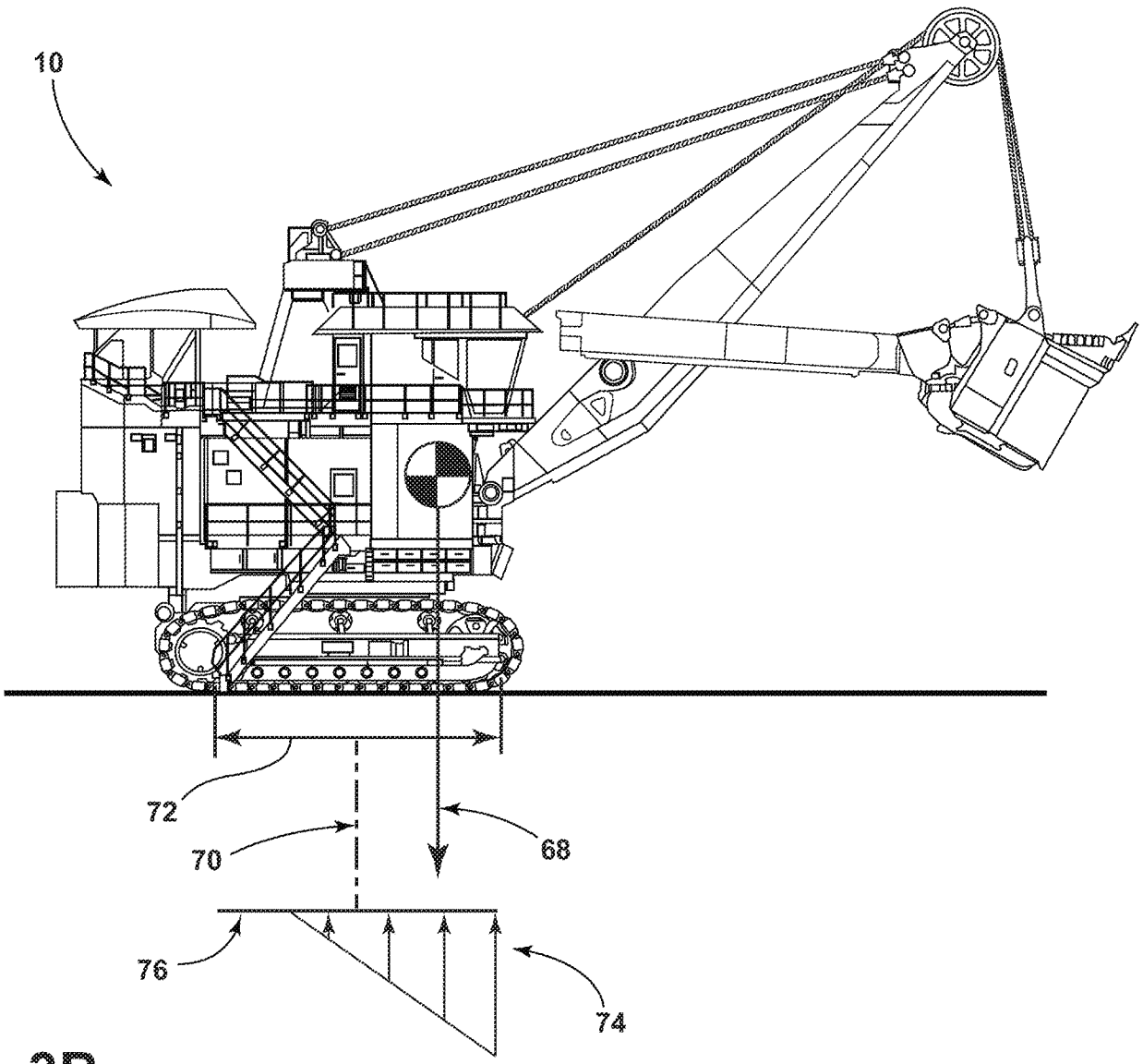

However, as illustrated in FIG. 3*b*, as the center of gravity 68 of the shovel 10 moves away from a centerline 70, the eccentricity, of the bearing length 72, positive ground pressure 74 is not distributed along the entire bearing length 62. In particular, as illustrated in FIG. 3*b*, positive ground pressure 74 is not applied to a rear portion 76 of the bearing length 72. This lack of positive ground pressure 74 indicates that the rear portion 76 of the bearing length 72 may not be touching the ground, which creates a situation where the shovel 10 may tip forward (for example, a bearing unloaded case) when the eccentricity of the center of gravity extends beyond the shovel's 10 bearing limits.

Figure 4A:
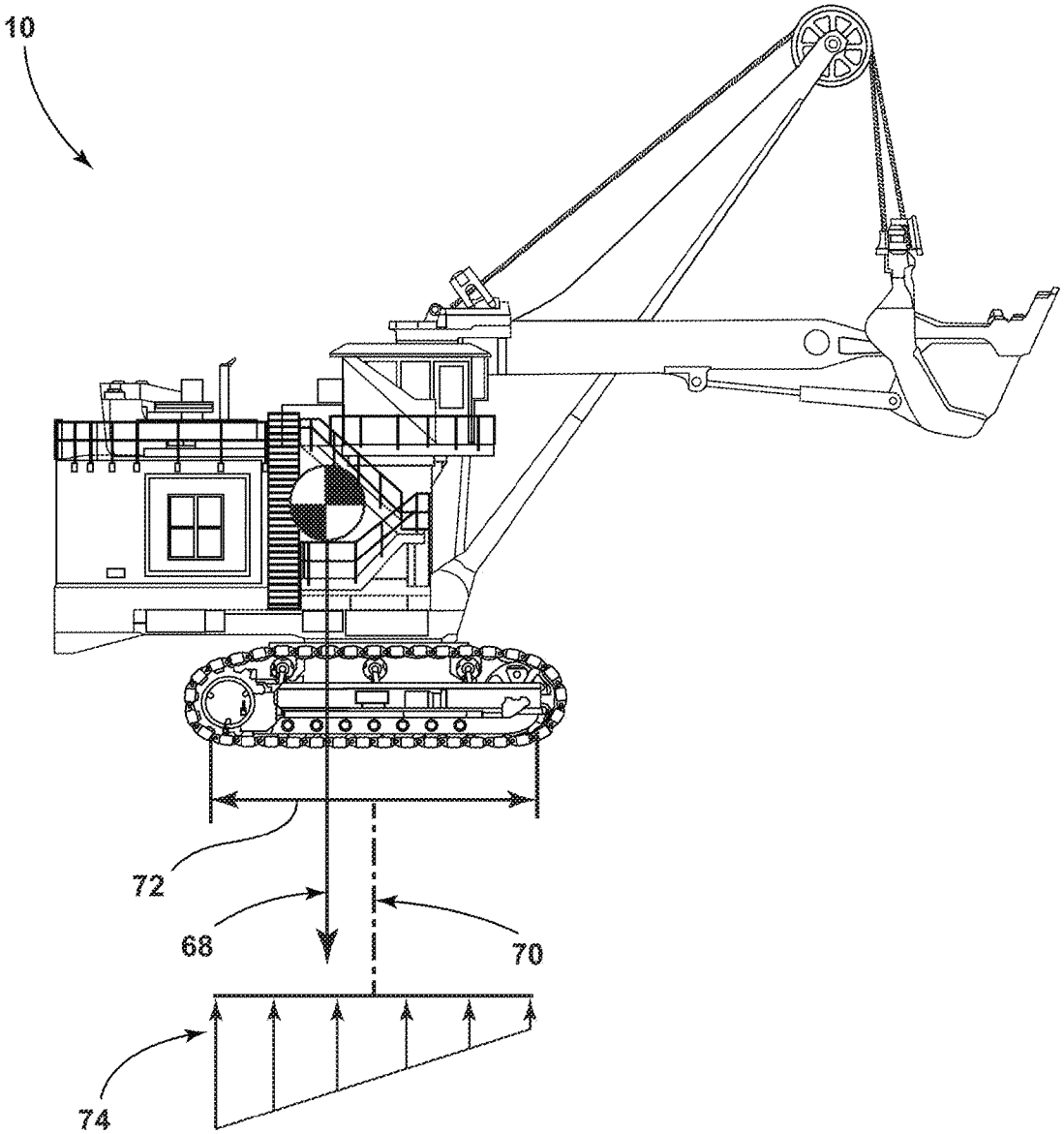
FIGS. 4A and 4B schematically illustrate an eccentricity of a center of gravity of the mining shovel of FIG. 1 in another situation.
Figure 4B:
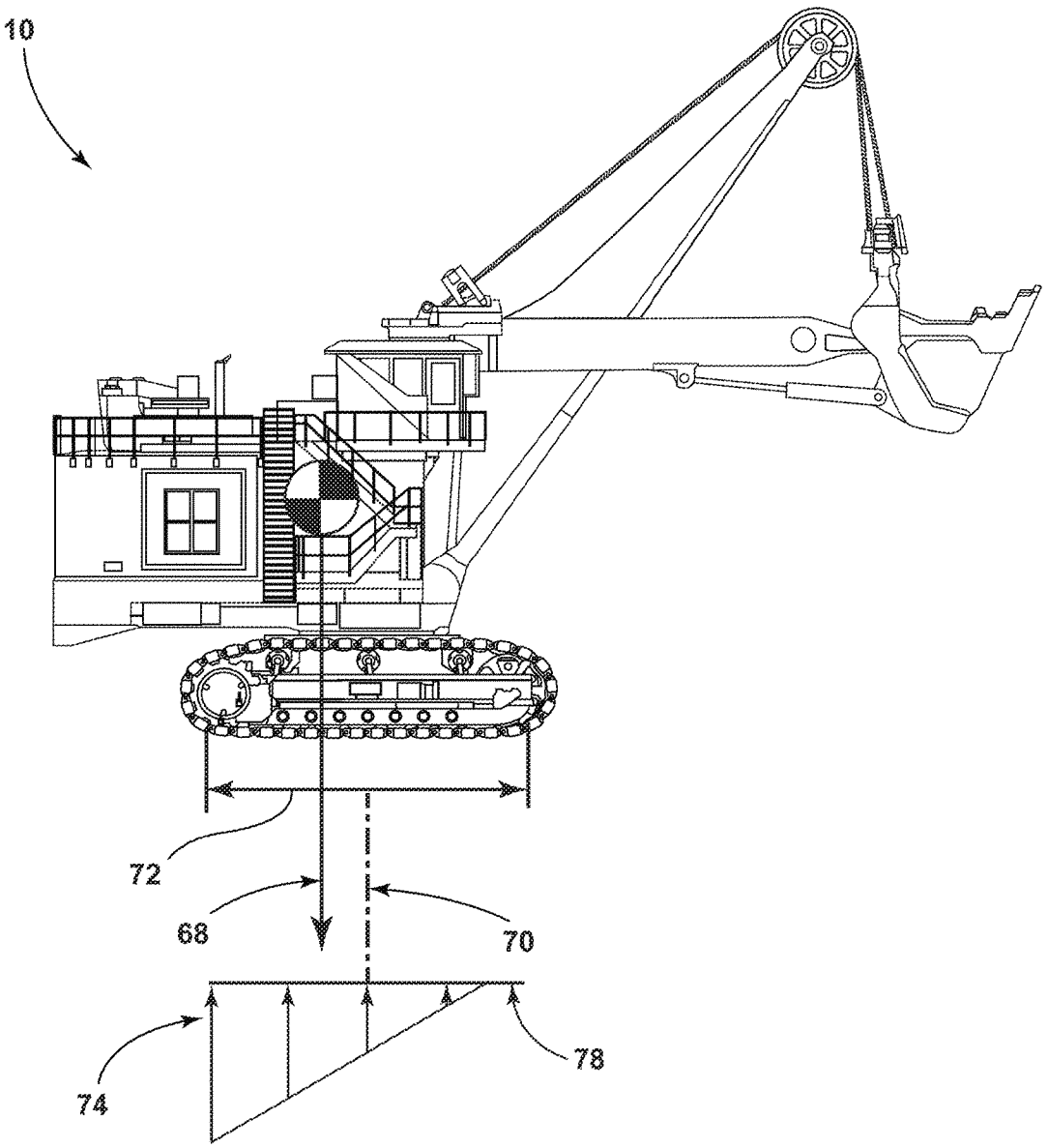

Similarly, as illustrated in FIG. 4*a*, when the dipper 38 is being lowered or extended, positive ground pressure 74 is distributed along the bearing length 72 in an increasing fashion from the rear to the front of the shovel 10 (a bearing loaded case). However, as illustrated in FIG. 4*b*, as the eccentricity of the center of gravity 68 of the shovel 10 moves away from the centerline 70, positive ground pressure 74 is not applied to a front portion 78 of the bearing length 72. This lack of positive ground pressure 74 indicates that the front portion 78 of the bearing length 72 may not be touching the ground, which creates a situation where the shovel 10 may tip backward (a bearing unloaded case).

Figure 5:
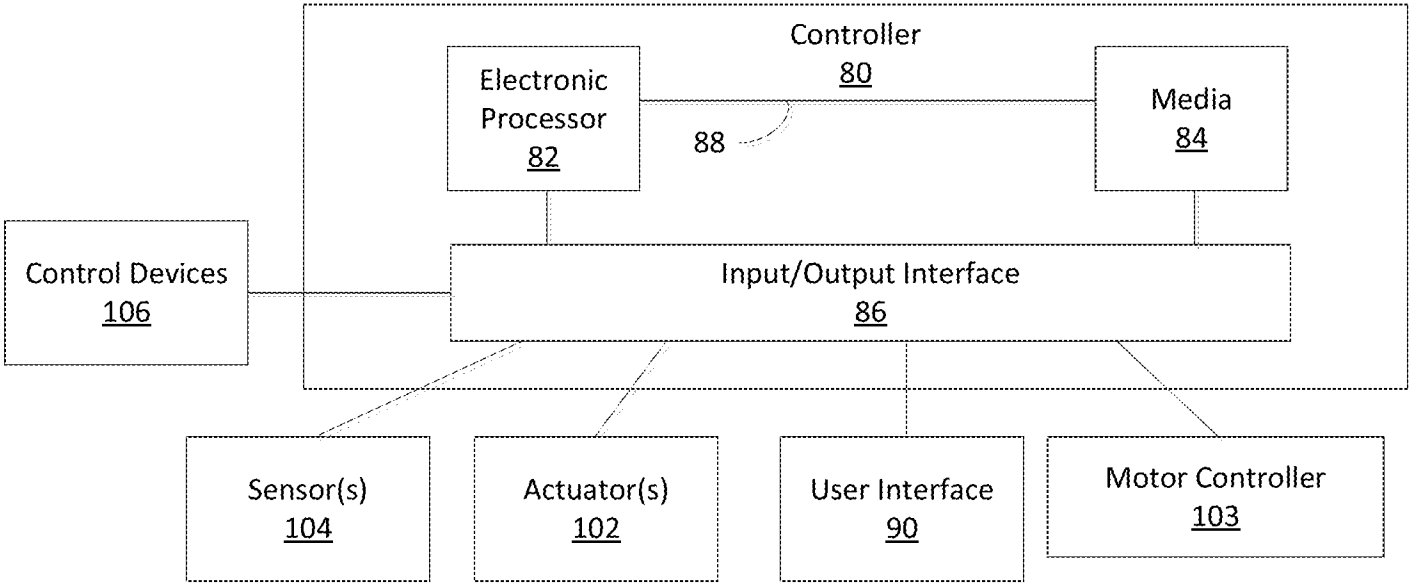
FIG. 5 schematically illustrates a controller providing stability control for the mining shovel of FIG. 1.

Accordingly, to manage stability of the shovel 10, embodiments of the invention provide a controller configured to monitor operation of the shovel 10 to detect an unstable condition of the shovel 10 and modify operation of the shovel 10 to manage the stability of the shovel 10. For example, FIG. 5 schematically illustrates a controller 80. The controller can be installed on the shovel 10 or remote from the shovel 10, such as a remote control device or station for the shovel 10. The controller 80 can include an electronic processor 82, a non-transitory computer-readable media 84, and an input/output interface 86. The electronic processor 82, the computer-readable media 84, and the input/output interface 86 are connected by and communicate through one or more communication lines or buses 88. It should be understood that in other constructions, the controller 80 includes additional, fewer, or different components. Also, it should be understood that controller 80 as described in the present application can perform additional functionality than the stabilization functionality described in the present application. Also, the functionality of the controller 80 can also be distributed among more than one controller.

The computer-readable media 84 stores program instructions and data. The electronic processor 82 is configured to retrieve instructions from the computer-readable media 84 and execute, among other things, the instructions to perform the control processes and methods described herein. The input/output interface 86 transmits data from the controller 80 to external systems, networks, and devices located remotely or onboard the shovel 10 (for example, over one or more wired or wireless connections). The input/output interface 86 also receives data from external systems, networks, and devices located remotely or onboard the shovel 10 (for example, over one or more wired or wireless connections). The input/output interface 86 provides received data to the electronic processor 82 and, in some embodiments, can also store received data to the computer-readable media 84.

In some embodiments, the controller 80 communicates with a user interface 90. The user interface 90 can allow an operator to operate the shovel 10 and, in some embodiments, displays feedback to an operator regarding whether the controller 80 has detected an unstable condition (for example, by generating a warning or providing an indication when automatic stabilization control is activated). For example, the user interface 90 can display information including an eccentricity of center of gravity 68 of the shovel 10, one or more ground pressures for the shovel 10, and warnings (for example, visual, audible, tactile, or combinations thereof) to the operator, such as when an unstable condition has been detected for the shovel 10 and, consequently, when automatic stabilization control is being provided by the controller 80.

In some embodiments, the controller 80 communicates with devices associated with the shovel 10 (for example, over one or more wired or wireless connections). For example, the controller 80 can be configured to communicate with the one or more actuators 102, which are used to operate the shovel 10 as described above. In an electric shovel, the actuators 102 can include a motor that controls the winch associated with the hoist cable 46 (for example, a hoist motor). Similarly, the actuators 102 can include a motor that controls crowd motion of the dipper handle 34 (a crowd motor). Similarly, the actuators 102 can include a motor that controls swing of the boom 30 (a swing motor). It should be understood that, in some embodiments, the controller 80 communicates with the actuators 102 directly and, in other embodiments, the controller 80 communicates with one or more of the actuator 102 through an actuator controller 103, such as a motor controller. For example, as described in more detail below, when the controller 80 determines that operation of one of the actuators 102 needs to be modified to control stability of the shovel 10, the controller 80 can send a signal to the actuator controller 103, which can communicate with the actuator 102 to implement the signal received from the controller 80.

In some embodiments, the controller 80 also communicates with one or more sensors 104 associated with the shovel 10. The sensors 104 monitor various operating parameters of the shovel 10, such as the location and status of the dipper 38. For example, the controller 80 can communicate with one or more crowd sensors, swing sensors, hoist sensors, and shovel sensors. The crowd sensors indicate a level of extension or retraction of the dipper 38. The swing sensors indicate a swing angle of the dipper handle 34. The hoist sensors indicate a height of the dipper 38 (for example, based on a position of the hoist cable 46 or the associated winch). The shovel sensors indicate whether the dipper door 39 is open (for dumping) or closed. The shovel sensors can also include weight sensors, acceleration sensors, and inclination sensors to provide additional information to the controller 80 about the load within the dipper 38. The shovel sensors can also include pressure sensors that measure a ground pressure experienced by the shovel 10 or a portion thereof.

In some embodiments, one or more of the sensor 104 are resolvers that indicate an absolute position or relative movement of an actuator (for example, a crowd motor, a swing motor, or a hoist motor). For instance, for indicating relative movement, as the hoist motor rotates to wind the hoist cable 46 to raise the dipper 38, hoist sensors can output a digital signal indicating an amount of rotation of the hoist and a direction of movement. The controller 80 can be configured to translate these outputs to a height position, speed, or acceleration of the dipper 38. Of course, it should be understood that the sensors can incorporate other types of sensors in other embodiments of the invention.

Furthermore, in some embodiments, the controller 80 receives input from operator control devices 106, such as joysticks, levers, foot pedals, and other actuators operated by the operator to control operation of the shovel 10. For example, the operator can use the operator control device 106 to issue commands, such as hoist up, hoist down, crowd extend, crowd retract, swing clockwise, swing counterclockwise, dipper door release, left crawler shoe 14 forward, left crawler shoe 14 reverse, right crawler shoe 14 forward, and right crawler shoe 14 reverse.

It should be understood that in some embodiments, one or more of the user interface 90, the actuators 102, the actuator controller 103, the sensors 104, and the operator control devices 106 can be included in the controller 80.

As noted above, the electronic processor 82 is configured to retrieve instructions from the computer-readable media 84 and execute, among other things, the instructions to perform control processes and methods for the shovel 10. For example, as noted above, the controller 80 can be configured to perform tipping control. Therefore, in some embodiments, the controller 80 is configured to perform the method 200 illustrated in FIG. 6 to detect an unstable condition of the shovel 10 and react accordingly.

Figure 6:
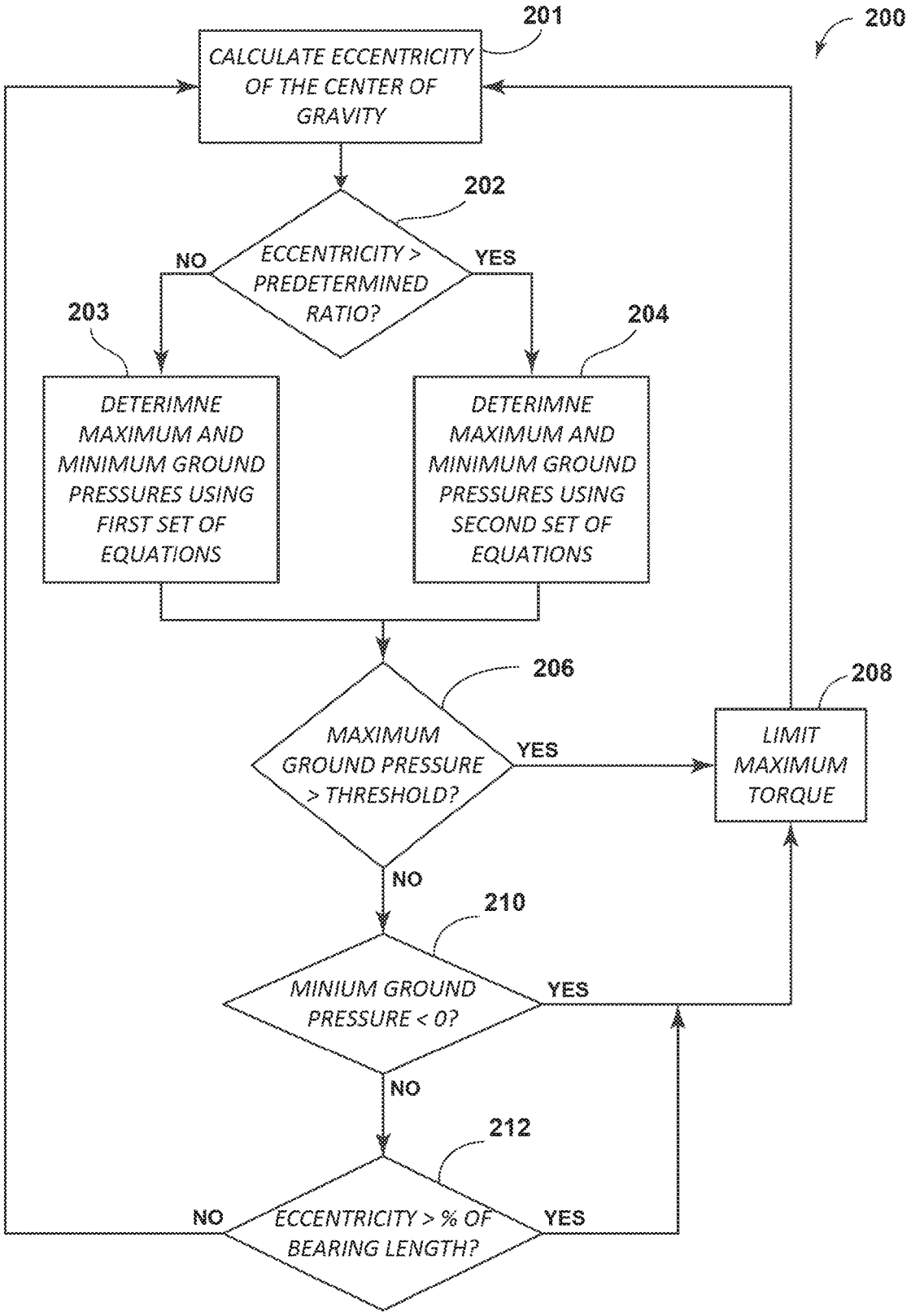
FIG. 6 is a flow chart illustrating a method of controlling the shovel of FIG. 1 performed by the controller of FIG. 5.

As illustrated in FIG. 6, the controller 80 (the electronic processor 82) can be configured to execute instructions to calculate an eccentricity of the center of gravity of the shovel 10 (at block 201). For example, the electronic processor 82 can execute instructions associated with the equations below to calculate an eccentricity of the center of gravity of the shovel 10 (referred to as "e" or "eccentricity" in the present application):

$$C.Gx(e) = \frac{\sum Moment_{BearingCenter}}{TotalMachineWeight} \quad \text{Equation (1)}$$

where:

$$\Sigma Moment_{BearingCenter} = Moment_{static} + Moment_{dynamic} \quad \text{Equation (2)}$$

$$Moment_{static} = \Sigma_{i=1}^{n} Weight_i \times C{\cdot}G Distance^i \text{ (without handle and dipper)} \quad \text{Equation (3)}$$

$$Moment_{dynamic} = BailPullForce \times BailPullForceDist + CrowdForces \times CrowdForcesDist \quad \text{Equation (4)}$$

As used in the present application, eccentricity of the center of gravity of the shovel 10 represents a scalar distance (as measured along the bearing length 72) between the bearing centerline 70 and the center of gravity of the shovel 10. It should be understood that the eccentricity calculations provided above can be simplified by eliminating some elements or can be more complex by adding more variables or inputs (for example, ground level). Also, as used in the above equations, the variable "$Moment_{static}$" represents a sum of the moments of each static component, where each moment is based on a component's weight and distance from the center of gravity of the shovel 10. Similarly, the variable "$Moment_{dynamic}$" represents a sum of the moments of each movable component, where each moment is based on a magnitude the forces associated with a component and the force's distance from a global origin where the centerline 70 and the ground level intersect. For example, as illustrated in Equation (4), the variable "$Moment_{dynamic}$" represents a sum of (1) the bail pull force 56 multiplied by the distance between the bail pull force 56 and the global origin and (2) the crowd forces 58 and 60 multiplied by the distance between the crowd forces 58 and 60 and the global origin.

In some embodiments, the eccentricity of the center of gravity is calculated based on one or more monitored operational parameters of the shovel 10. The monitored operational parameters of the shovel 10 can include, but are not limited to, the bail pull force, the position of the dipper 38, or the incline of the crawler shoes 14. The monitored operational parameters can be monitored by the sensors 58 or can be tracked by the controller 80.

After calculating the eccentricity, the controller 80 determines a minimum ground pressure ("$P_{min}$") and a maximum ground pressure ("$P_{max}$"). In some embodiments, the controller 80 uses two different sets of equations to determine the minimum and maximum ground pressures depending on the eccentricity. For example, a first set of equations may be applied for a bearing loaded case, and a second set of questions may be applied for a bearing unloaded case. In particular, as illustrated in FIG. 6, the controller 80 compares the calculated eccentricity to a predetermined ratio of the bearing length 72 (at block 202). In some embodiments, the predetermined ratio is one-sixth of the bearing length 72. Accordingly, when the eccentricity is less than or equal to predetermined ratio (for example, less than or equal to one-sixth of the bearing length 72 representing a bearing loaded case), the controller 80 uses a first set of equations to calculate the minimum and maximum ground pressure (at block 203). In some embodiments, the first set of equations includes Equations (5) and (6) provided below:

$$P_{max} = \frac{Q}{BL} + \frac{6M}{B^2L} \quad \text{Equation (5)}$$

$$P_{min} = \frac{Q}{BL} - \frac{6M}{B^2L} \quad \text{Equation (6)}$$

Where "Q" represents total machine weight, "B" represents bearing length 72, "L" represents the sum of the length of each crawler shoe 14 (for example, length of left crawler shoe 14 plus length of right crawler shoe 14), and "M" represents the summation of the static and dynamic moments (for example, about a global origin) including shovel component weight forces and the hoist and crowd reaction forces. In some embodiments, the value of "B" can be measured on the shovel 10 (for example, a distance between idlers included in the bearing 18), calculated based on one or more components of the shovel 10 (for example, a crawler shoe thickness), or a combination thereof.

As noted above in Equation (1), eccentricity of the center of gravity is provided by Equation (7) below:

$$e = \frac{M}{Q} \quad \text{Equation (7)}$$

Therefore, in some embodiments, Equation (7) can be substituted into Equations (5) and (6) to yield the following Equations (8) and (9) for calculating a minimum pressure and a maximum pressure for a bearing loaded case:

$$P_{max} = \frac{Q}{BL}\left(1 + \frac{6e}{B}\right) \quad \text{Equation (8)}$$

$$P_{min} = \frac{Q}{BL}\left(1 - \frac{6e}{B}\right) \quad \text{Equation (9)}$$

When the eccentricity is greater than the predetermined ratio (for example, greater than one-sixth of the bearing length 72 representing a bearing unloaded case), the controller 80 uses a second set of equations to determine the minimum and maximum ground pressure (at block 204). In some embodiments, the second set of equations includes Equations (10) and (11) provided below:

$$P_{max} = \frac{4Q}{3L(B - 2e)} \quad \text{Equation (10)}$$

$$P_{min} = 0 \quad \text{Equation (11)}$$

The determined maximum pressure (generated using Equation (8) or Equation (10)) represents a maximum pressure experienced by the crawler shoes 14 along the bearing length 62. When the determine maximum pressure gets too large, too much pressure may be asserted on a portion of the crawler shoes 14 along the bearing length 62 that may indicate that the shovel 10 is unstable (for example, starting to tip forward or backward). Accordingly, the controller 80 can be configured to execute instructions to compare the maximum pressure to a predetermined threshold (for example, "$P_{allow}$," which is set based on characteristics of the shovel 10) (at block 206). When the calculated or sensed maximum pressure exceeds the predetermined threshold, the controller 80 limits the maximum torque supplied by the one or more actuators 102 (at block 208).

In some embodiments, the controller 80 can be configured to limit the maximum hoist torque (torque used to raise and low the dipper 38). The controller 80 can limit the maximum hoist torque in a step-wise fashion, such as by using the below equation:

$$\text{Hoist Torque Maximum} = X\% \text{ of Default Torque Maximum Equation} \quad (12)$$

Accordingly, using Equation (12), the controller 80 sets the maximum hoist torque of the actuators 102 to a percentage of a default or available maximum hoist torque, which, in some embodiments, can vary from 50% to 90% or from 80% to 90% of the maximum available hoist torque or other ranges of torque percentages. Also, in some embodiments, the maximum hoist torque can be set to 0% of the available maximum hoist torque to stop hoist motion.

In other embodiments, the controller 80 can be configured to limit maximum hoist torque in a linear fashion or equation based limit, such as by using the below equation:

$$\text{Hoist Torque Maximum} = Y/(P_{max} - P_{allow})\% \text{ of Default Torque Maximum Equation} \quad (13)$$

The "X" and "Y" variables used in Equations (12) and (13) can be static values (for example, set based on the characteristics of the shovel 10), which may be the same values or different values. In addition, in some situations, the static values of Equations (12) and (13) can vary based on the condition causing a torque limit (for example, whether the maximum pressure exceeds a threshold or whether the minimum pressure fails below zero). Also, in some situations, the maximum hoist torque may be set to the same amount (the same percentage) regardless of whether the step-wise limit or the linear limit is applied.

Rather than use the above equations, the controller 80 can be configured to set the maximum hoist torque proportional to the calculated eccentricity of the center of gravity. Additionally, in some embodiments, an operator can select the torque limit (for example, a step-wise reduction, a linear reduction, or a specific limit) (for example, through the user interface 90). Also, it should be understood that in some embodiments, the controller 80 can limit the maximum torque supplied by other actuators 102 included in the shovel 10 in addition to or as an alternative to limiting the maximum torque supplied by the actuator 102 supplying a hoist torque. For example, in some embodiments, the controller 80 limit maximum crowd torque in addition to or as an alternative to limiting maximum hoist torque.

In some embodiments, the controller 80 is configured to send instructions to the actuator controller 103 to limit the torque of the actuator 102. The actuator controller 103 receives the signal from the controller 80 and limits the actuator 102 accordingly.

As illustrated in FIGS. 3*b* and 4*b*, in some situations, the eccentricity of the center of gravity 68 of the shovel 10 may cause a portion of the bearing length 72 to experience zero or negative ground pressure, which may create unstable condition because a portion of the crawler shoe 14 is not touching the ground. Therefore, as illustrated in FIG. 6, the controller 80 can be configured to determine whether the minimum ground pressure is less than zero (at block 210). When the minimum ground pressure is less than zero, the controller 80 can be configured to limit the maximum torque supplied by the one or more actuators 102 as described above (at block 208).

Similarly, as illustrated in FIG. 6, the controller 80 can be configured to limit torque based on how far the center of gravity of the shovel 10 has shifted from the centerline 70. For example, the controller 80 can be configured to determine whether the calculated eccentricity of the center of gravity of the shovel 10 is greater than a predetermined percentage (for example, approximately 10% to 20%) of the bearing length 72 (at block 212). When the eccentricity is greater than the predetermined percentage of the bearing length 72, the controller 80 can be configured to limit the maximum torque supplied by the one or more actuators 102 as described above (at block 208).

It should be understood that the same or different equations for limiting torque can be applied depending on whether the maximum ground pressure exceeds the threshold, the minimum ground pressure falls below zero, or the eccentricity exceeds the predetermined percentage of the bearing length 72 (for example, different reductions, different reduction types (for example, step-wise v. linear), different static variable, different torques (for example, limiting hoist torque v. limiting crowd torque), and the like). Also, in some embodiments, different torque limits can be applied based on whether all three of these conditions are satisfied, only two of these conditions are satisfied, or only one of these conditions is satisfied. Also, it should be understood that the controller 80 can be configured to detect an unstable condition by detecting one, two, or all three of these conditions. Also, in some embodiments, the controller 80 may be configured to detect more than one of these conditions only when an initial condition is satisfied (for example, the maximum ground pressure exceeds the predetermined threshold).

In some embodiments, in addition to or as an alternative to calculating the minimum and maximum ground pressures, the controller 80 can be configured to detect one or more ground pressures along the bearing length 72 using one or more sensors 104, which can include one or more pressure sensors. For example, in some embodiments, pressure sensors can be positioned proximate a lower portion of the shovel 10 (for example, proximate the crawler shoes 14 or the bearing 18, such as on an idler shaft, a crawler frame, and the like) that are configured to sense a pressure indicative of the ground pressure. These sensors can communicate sensed data to the controller 80, and the controller 80 can then use the sensed data (for example, directly or after further processing) to determine one or more ground pressures that can be compared to the pressure thresholds (for example, "$P_{allow}$" and zero) described above. In some embodiments, the controller 80 can use sensed pressures as a check or to adjust calculated pressures.

As illustrated in FIG. 6, the controller 80 can be configured to repeatedly check for an unstable condition by repeating one or more of the above calculations and comparisons (for example, continuously or at predetermined time intervals). In some embodiments, the controller 80 can be configured to apply a torque limit until no torque limiting situations exist or the torque limiting situation that initially caused the limit no longer exists. In other embodiments, the controller 80 can be configured to apply a torque limit for a predetermined period before returning the shovel 10 to normal operation (unlimited hoist torque). Also, in some embodiments, once a limit is applied by the controller 80, the limit can be constant until a torque limiting situation is no longer detected. However, in other embodiments, the controller 80 can be configured to adjust an applied limit as necessary (for example, based on measured operating parameters, such as eccentricity, ground pressure, speed, load, and the like or based on a predetermined adjustment schedule, such as decreasing the limit in a step-wise or linear fashion over a period of time). For example, the controller 80 can be configured to continuously "re-set" (for example, increase or decrease) the torque limit as the circumstances change. In particular, when the maximum ground pressure is above the predetermined threshold, the controller 80 can be configured to initial limit torque and, as the maximum ground pressure increases, the controller 80 can be configured to increase the torque limit.

Figure 7:
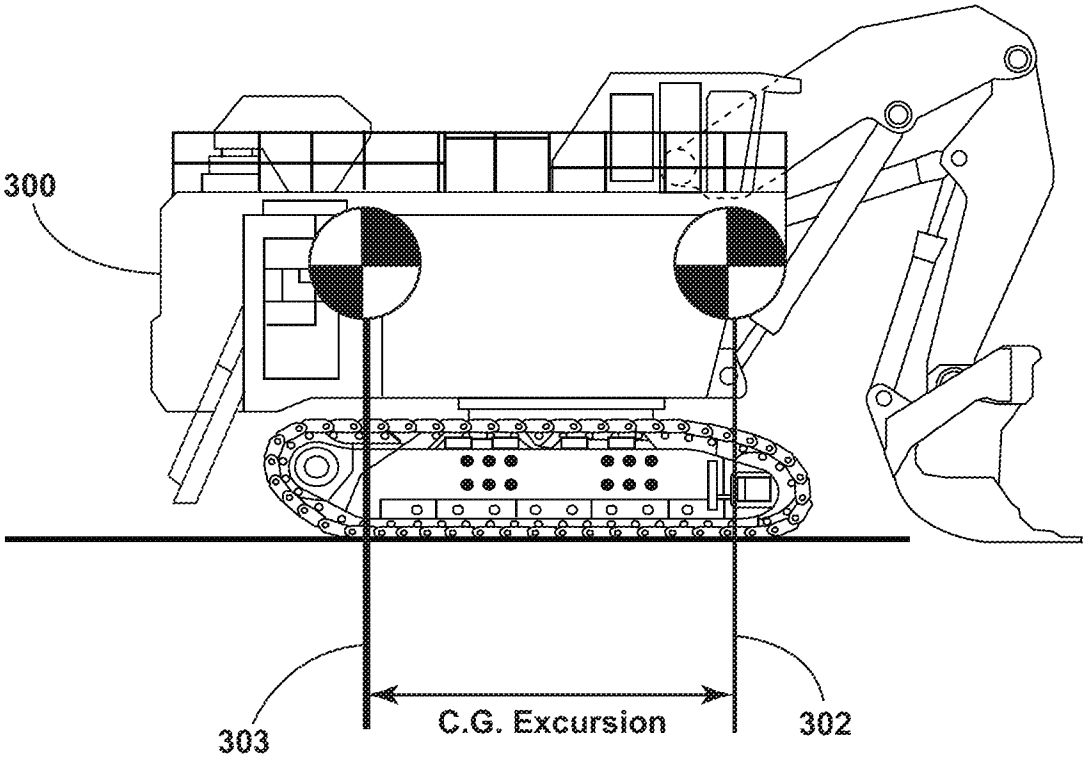
FIG. 7 schematically illustrates a hydraulic excavator.

It should be understood that the functionality to control the eccentricity described above can be used with industrial machines other than just shovels. For example, the eccentricity functionality can be used with an excavator 300 (see FIG. 7). With an excavator 300, machine stability can be provided by limiting crowd torque, hoist torque, or combinations thereof as described above. As illustrated in FIG. 7, the center of gravity of an excavator 300 can travel between a front position 302 and a rear position 303. Accordingly, a controller associated with the excavator 300 can track the position of the excavator's center of gravity between these positions (for example, with respect to the front position 302, the rear position 303, or a center position defined between the positions 302 and 303) to determine an eccentricity of the center of the gravity of the excavator 300 as described above. Similarly, it should be understood that a different point of reference than the centerline 70, such as a front position or a rear position, could be to calculate an eccentricity of the center of gravity for the shovel 10.

Also, in some embodiments, information from one or more of the sensors 104 can be used to detect an unstable condition as an alternative to or in addition to the eccentricity and ground pressure values described above. For example, in some embodiments, one or more inclinometers can be used to detect tipping of the shovel 10 and torque limits can be applied based on a magnitude of a detected angle or incline of the shovel or a rate of change of a detected angle or incline of the shovel 10 (or a component thereof, such as the dipper 38). Similarly, positions of the dipper 38 (for example, height, crowd, or both) can be tracked using the sensors 104, and the controller 80 can limit torque based on a position of the dipper 38 or a rate of change in position of the dipper 38 (for example, in a particular direction or multiple directions).

Additionally, in some embodiments, the controller 80 is configured to execute instructions to monitor an inclination of the surface supporting the shovel 10 and compare the inclination to a dig slope limit, which indicates a maximum inclination of the shovel 10. As described in more detail below, the controller 80 can also be configured to trigger automatic control of the shovel 10 when the inclination approaches or exceeds the dig slope limit to mitigate or prevent a tip over situation.

Figure 9:
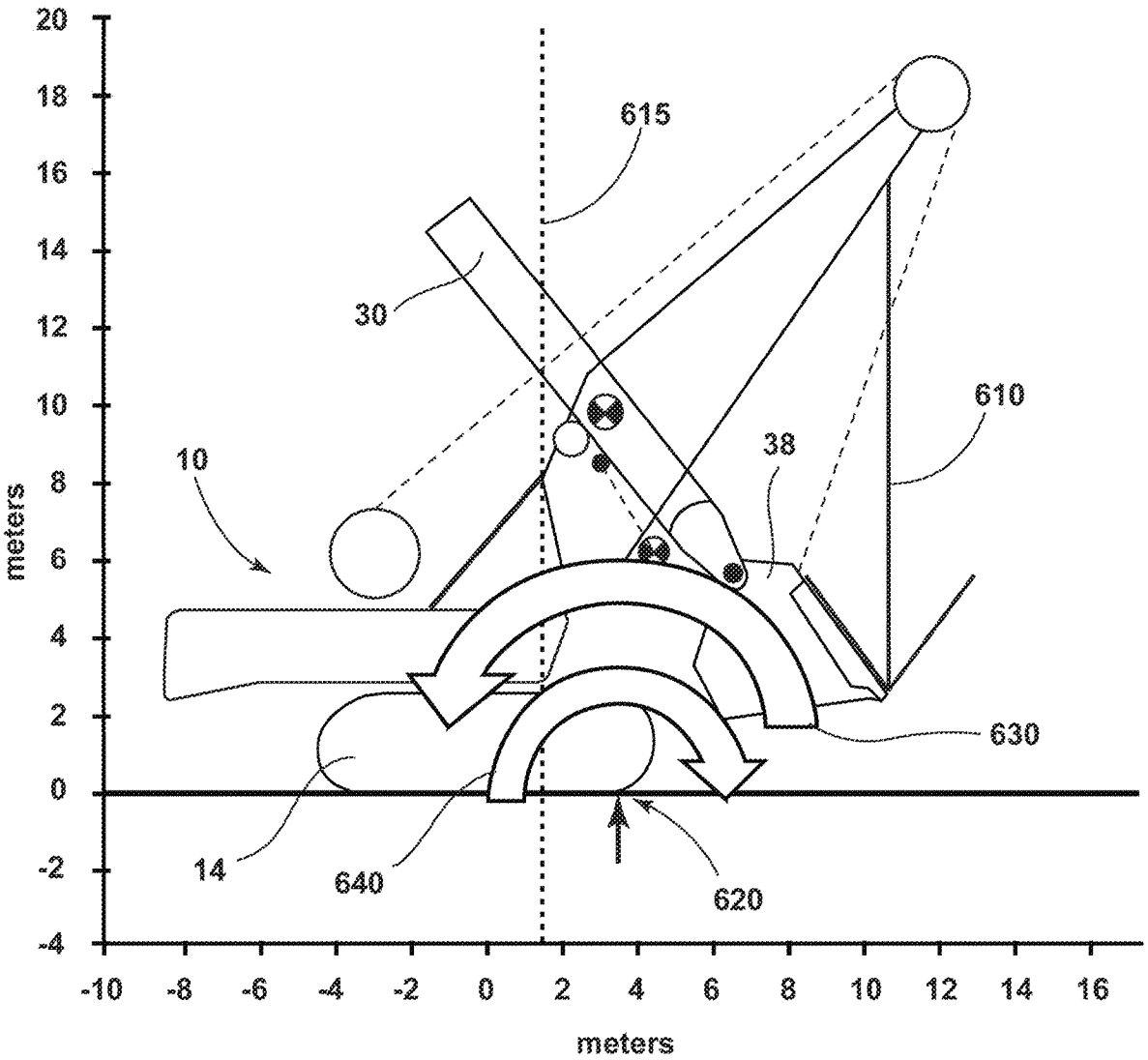
FIG. 9 schematically illustrates a forward and a rearward tipping moment about a tipping edge of the shovel of FIG. 1.

For example, as noted above, digging on a level grade keeps the shovel 10 balanced, which provides operator comfort and keeps structural and mechanical components less stressed leading to longer life. In a mining environment, however, digging on a level grade is not always possible as the pit floor is not always level. For these situations, a dig slope limit can be set for the shovel 10, which indicates the maximum inclination of the surface supporting the shovel 10 while the shovel 10 is digging in a bank. The dig slope limit can be set based on, for example, an overall center of gravity of the shovel 10, a reach of the shovel 10, a bail pull level, and a tipping point location of an undercarriage of the shovel 10. For example, as illustrated in FIG. 9, when the overall center of gravity 605 of the shovel 10, including a dig force 610 on the dipper 38 (for example, at teeth of the dipper 38 generated and proportional to bail pull), has a eccentricity 615 that exceeds (for example, in the forward or backward direction) the tipping point location 620 of the undercarriage, the shovel 10 could tip over. In particular, as illustrated in FIG. 9, based on the forces acting on the shovel 10, the shovel 10 has a rearward moment 630 about the tipping point location 620 and a forward moment 640 about the tipping point location 620. In some embodiments, for the shovel 10 to be in a stable condition, a ratio of the rearward moment 630 to the forward moment 640 should be greater than or equal to approximately 1.0. When this ratio is less than approximately 1.0, motion of the shovel 10 (for example, hoist motion impacting hoist bail force) could cause the shovel 10 to start to tip.

Also, in some embodiments, the tipping point location 620 differs depending on whether the operator is digging in front of the shovel 10 (the crawler shoes 14 are positioned perpendicular to the bank and parallel to the inclination 650)

Figure 10:
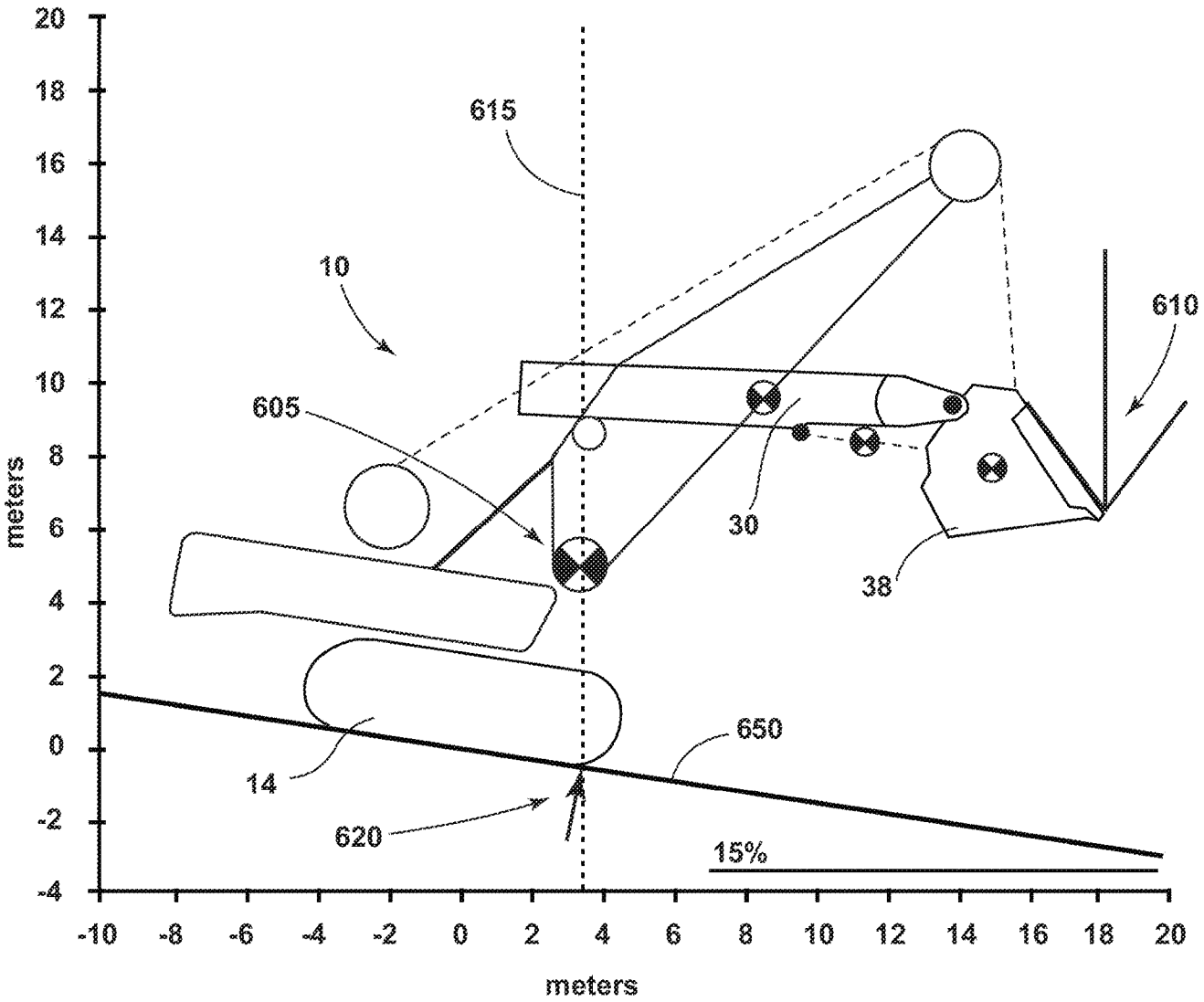
FIG. 10 schematically illustrates the shovel of FIG. 1 digging over a front of the shovel.
Figure 11:
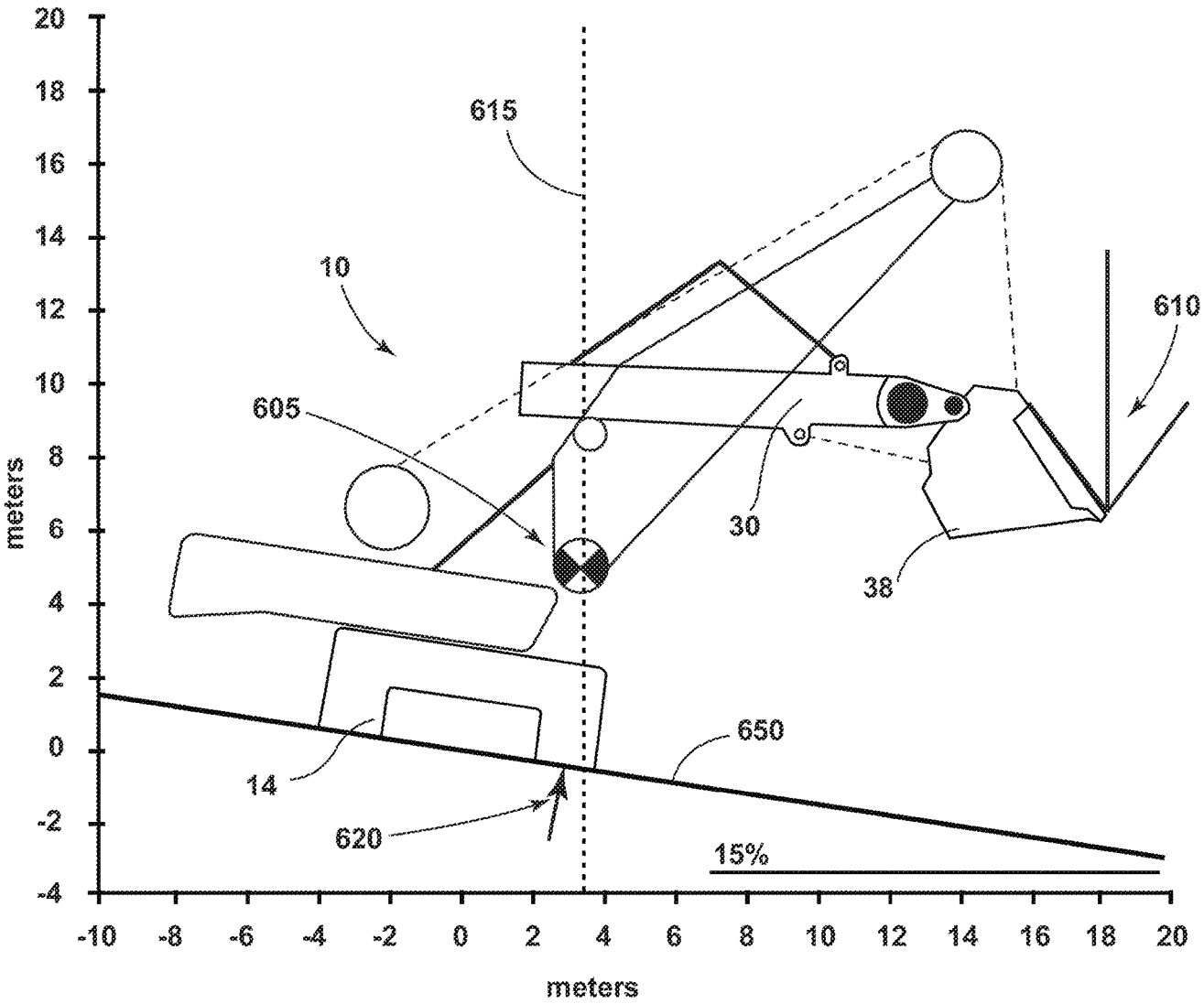
FIG. 11 schematically illustrates the shovel of FIG. 1 digging over a side of the shovel.

(see FIG. 10) or over the side of the shovel 10 (the crawler shoes 14 are positioned parallel to the bank and perpendicular to the inclination) (see FIG. 11). For example, as illustrated in FIG. 10, the tipping point location 620 when the shovel 10 is positioned on a downward inclination generally corresponds to the front of the crawler shoes 14 (for example, the furthest edge of lower rollers included in the crawler shoes 14) when the operator is digging in front of the shovel 10. Alternatively, as illustrated in FIG. 11, the tipping point location 620 generally corresponds to the side of the crawler shoe 14 closest to the bank (for example, the furthest edge of lower rollers included in the crawler shoe 14 closest to the bank) when the operator is digging over the side of the shovel 10. It should be understood that the tipping point locations can switch from the edge of the crawler shoes 14 closest to the front of the shovel 10 to the edge of the crawler shoes 14 closest to the rear of the shovel 10 when the shovel 10 is positioned on an upward inclination (an inclination that rises toward the front of the shovel 10).

Accordingly, the dig slope limit may differ depending on whether the operator is digging over the front or over the side of the shovel 10. For example, in some embodiments, the dig slope limit when the shovel 10 is digging over the front is approximately 15% and the dig slope limit when the shovel 10 is digging over the side is approximately 6%. Also, in some embodiments, a counterweight extends off the shovel 10 in a direction opposite of the boom 30 that helps balance the center of gravity of the shovel 10 when the operator is digging over the front (with the boom 30 off the front of the shovel 10).

Although the dig slope limit may technically differ depending on whether the shovel 10 is digging over the front or over a side, the shovel 10 may have requirements that it be able to dig on any inclination less than a predetermined amount. For example, a 2650CX shovel provided by P&H Mining Equipment may have a requirement that it can dig any incline of 15% or less regardless of whether the shovel is digging over the front or over the side. Accordingly, when digging over the side, it may be difficult for an operator to satisfy the digging requirements of the shovel while still maintaining shovel stability.

For example, as noted above, FIG. 10 illustrates the shovel 10 digging over the front of the shovel 10 (with the crawler shoes 14 positioned parallel to the inclination 650). When the overall center of gravity 605 of the shovel 10, including a dig force 610 on the dipper 38 (for example, at teeth of the dipper 38), has an eccentricity 615 that exceeds the tipping point location 620 (in either the forward or backward direction), the shovel 10 could tip over. As illustrated in FIG. 10, in some embodiments, when the inclination 650 is less than or equal to approximately 15%, the eccentricity 615 does not exceed the tipping point location 620, which means the shovel 10 is counter-weighted to handle a full stall bail pull without creating an unstable condition. However, when the inclination 650 is greater than approximately 15%, the eccentricity 615 moves forward, which indicates that the shovel 10 is unstable and could tip during digging.

Similarly, as noted above, FIG. 11 illustrates the shovel 10 digging over the side of the shovel 10 (with the crawler shoes 14 positioned perpendicular to the inclination 650). When the overall center of gravity 605 of the shovel 10, including a dig force 610 on the dipper 38 (for example, at teeth of the dipper 38), has an eccentricity 615 that exceeds the tipping point location 620, the shovel 10 could tip over. As illustrated in FIG. 11, due to the change in position of the tipping point location 620 and the counter-weight when the shovel 10 is digging over the side of the shovel 10, the eccentricity 615 can exceed the tipping point location 620 even though the eccentricity 615 would not exceed the tipping point location 620 on the same inclination when the shovel 10 were digging over the front of the shovel 10 (see FIG. 10). Accordingly, as noted above, in some embodiments, the dig slope limit is reduced when the shovel 10 is digging over the side of the shovel 10. For example, in some embodiments, the dig slope limit can be reduced proportionally to the tipping point of the specific machine (for example, reducing the limit from 10% to 6% for a given model).

The operator of the shovel 10 benefits from being able to identify when the dig slope limit set for the shovel 10 is being encountered. In other words, the operator benefits from knowing the dig slope limit set for the shovel 10 and whether he or she is nearing (or has exceeded) the limit. Accordingly, as described in more detail below, the controller 80 can be configured to monitor the inclination associated with the shovel 10, detect when the inclination is approaching a dig slope limit, and automatically control the shovel 10 in response to the inclination approaching the dig slope limit to prevent the shovel 10 from exceeding the dig slope limit. Also, in some embodiments, when the dig slope limit is exceeded, the controller 80 can be configured to prevent the operator from operating the shovel with full capability or at all until the inclination is reduced to less than the dig slope limit. In addition, in some embodiments, the controller 80 is configured to automatically generate one or more warnings that inform the operator when the dig slope limit is being approached (or exceeded).

In particular, as described in more detail below, the controller 80 can be configured to determine whether the shovel 10 is digging over the front or over the side and apply a different dig slope limit accordingly. For example, as noted above, in some embodiments, the dig slope limit of the shovel 10 is greater when the crawler shoes 14 are positioned perpendicular to the bank (parallel to the inclination 650) (see FIG. 10) than when the crawler shoes 14 are positioned parallel to the bank (perpendicular to the inclination 650) (see FIG. 11). In particular, in some embodiments, the controller 80 is configured to execute a different set of instructions to control the shovel 10 depending on the position of the crawler shoes 14 relative to the inclination 650 and the position of the boom 30 relative to the crawler shoes 14.

For example, the controller 80 may control the shovel 10 when the shovel 10 is in two different positions or scenarios. In particular, the controller 80 may control the shovel 10 according to a first set of instructions under Scenario A (shown in FIG. 10) when the shovel 10 is positioned with the crawler shoes 14 extending parallel to the inclination 650 with the boom 30 digging over the front of the shovel 10. In some embodiments, under Scenario A, the shovel 10 has a dig slope limit of approximately 15%, which means that the shovel 10 is designed to be stable up to an inclination 650 of approximately 15% and is capable of maintaining a stable position without limiting the hoist bail pull and bail speed. Accordingly, under Scenario A, the controller 80 executes instructions to alert the operator when the inclination 650 is approaching (for example, within a predetermined amount) or has exceeded the dig slope limit. In some embodiments, the controller 80 is also configured to automatically limit the available hoist bail force and hoist speed when the inclination 650 approaches or exceeds the dig slope limit.

Similarly, the controller 80 may control the shovel 10 according to a second set of instructions under Scenario B (shown in FIG. 11) when the shovel 10 is positioned with the crawler shoes 14 extending perpendicular to the inclination 650 with the boom 30 digging over the side of the shovel 10. In some embodiments, under Scenario B, the shovel 10 has a dig slope limit of approximately 6%, which means the shovel 10 is designed to remain stable up to an inclination 650 of approximately 6% without limiting the hoist bail pull and bail speed. Accordingly, under Scenario B, the controller 80 executes instructions to alert the operator when the inclination 650 is approaching or has exceeded the dig slope limit. In some embodiments, the controller 80 is also configured to automatically limit the available hoist bail force and host speed when the inclination 650 approaches or exceeds the dig slope limit.

Figure 12:
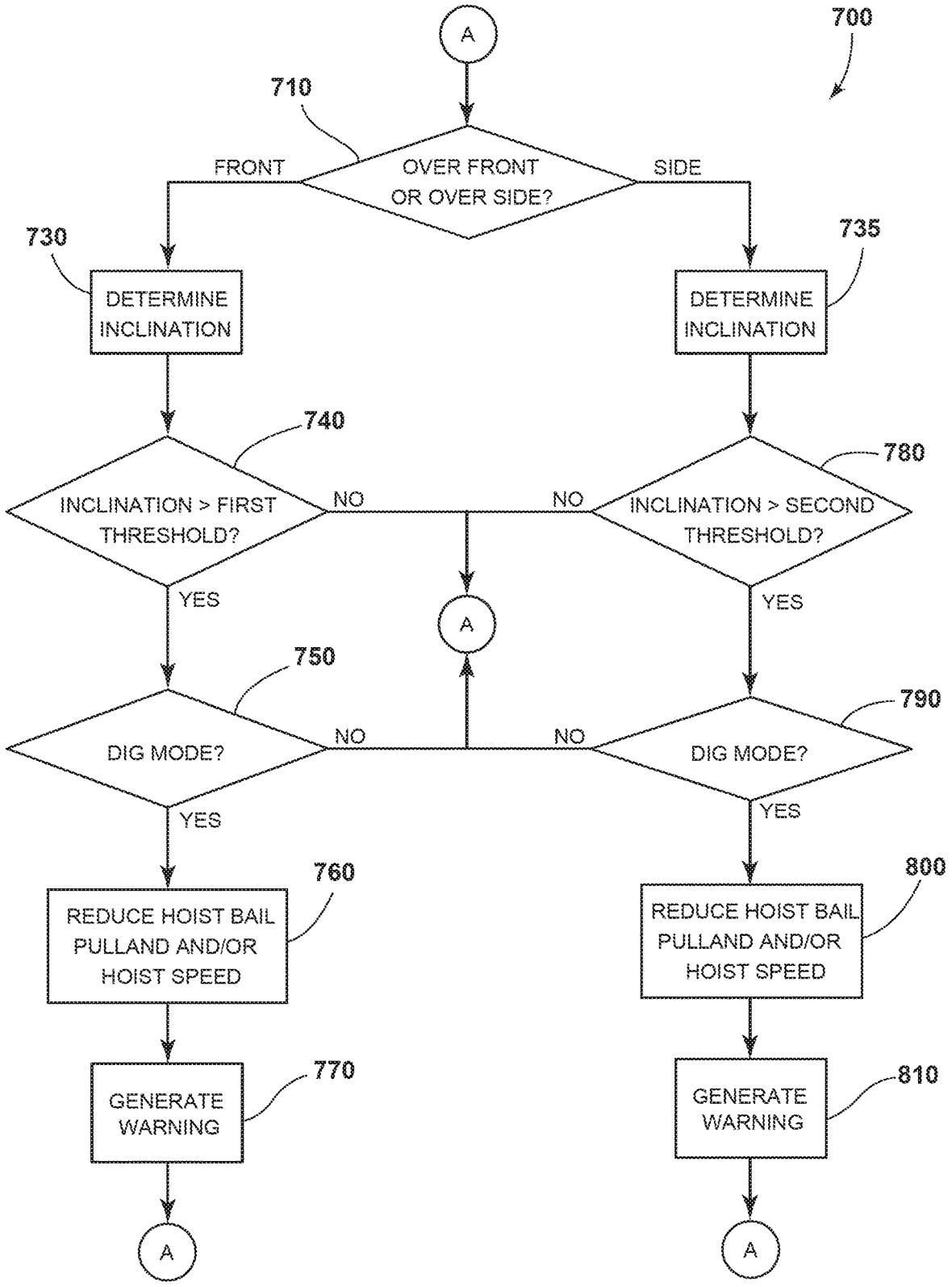
FIG. 12 is a flow chart illustrating a method of controlling the shovel of FIG. 1 based on a dig slope limit associated with the shovel.

For example, FIG. 12 provides a flow chart of a method 700 of controlling the shovel 10 based on whether the shovel 10 is digging over the front or over the side (for example, the position of the crawler shoes 14 relative to the inclination 650 and the direction of the boom 30 relative to the crawler shoes 14). As noted above, the controller 80 can be configured to execute different instructions (applying different functionality) depending on whether the shovel 10 is under Scenario A or Scenario B. Accordingly, as illustrated in FIG. 12, the method 700 includes determining whether the shovel 10 is positioned according to Scenario A (digging over the front) or Scenario B (digging over the side) (at block 710).

Figure 13:
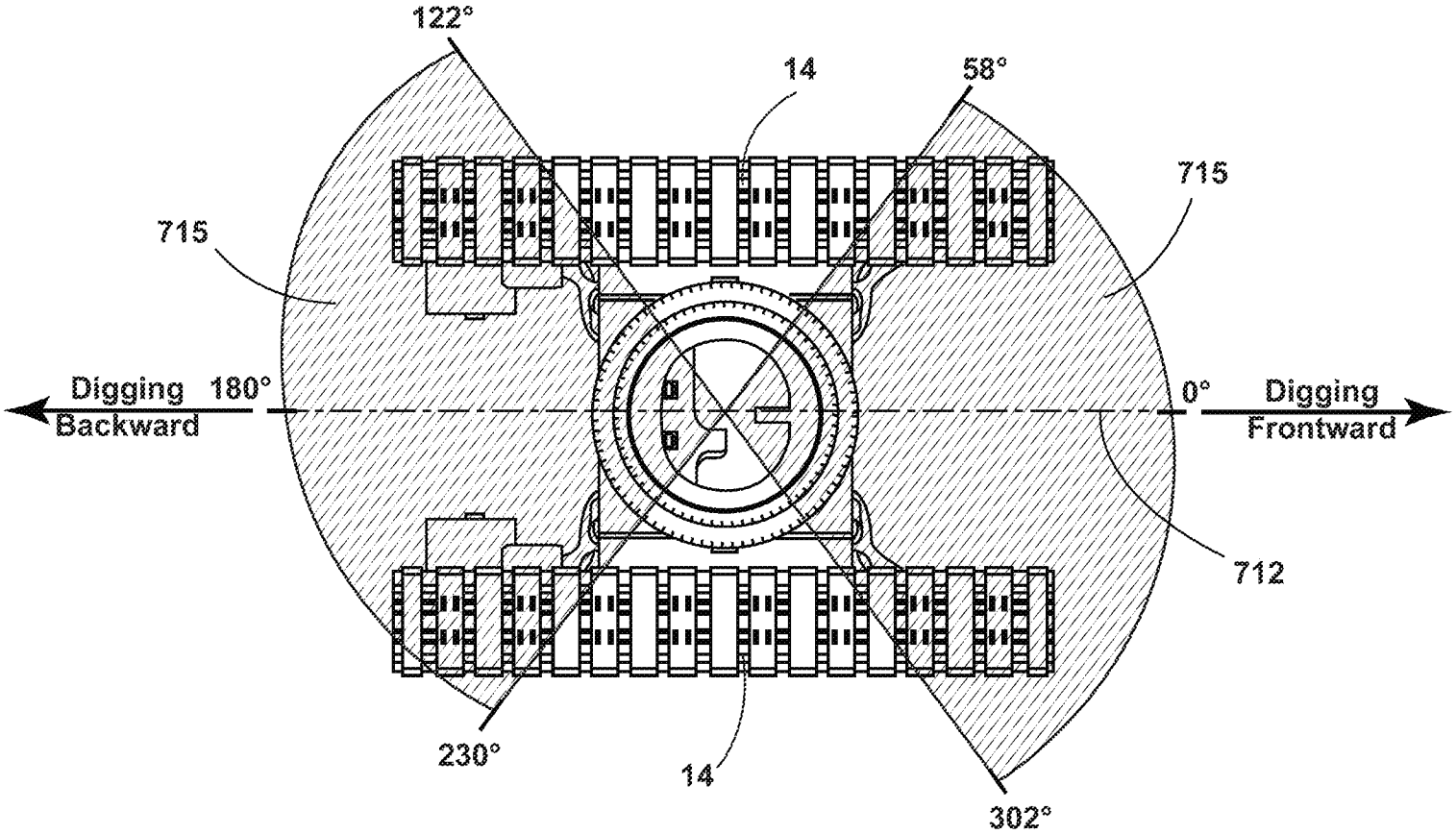
FIG. 13 schematically illustrates a first angle range of the shovel of FIG. 1.
Figure 14:
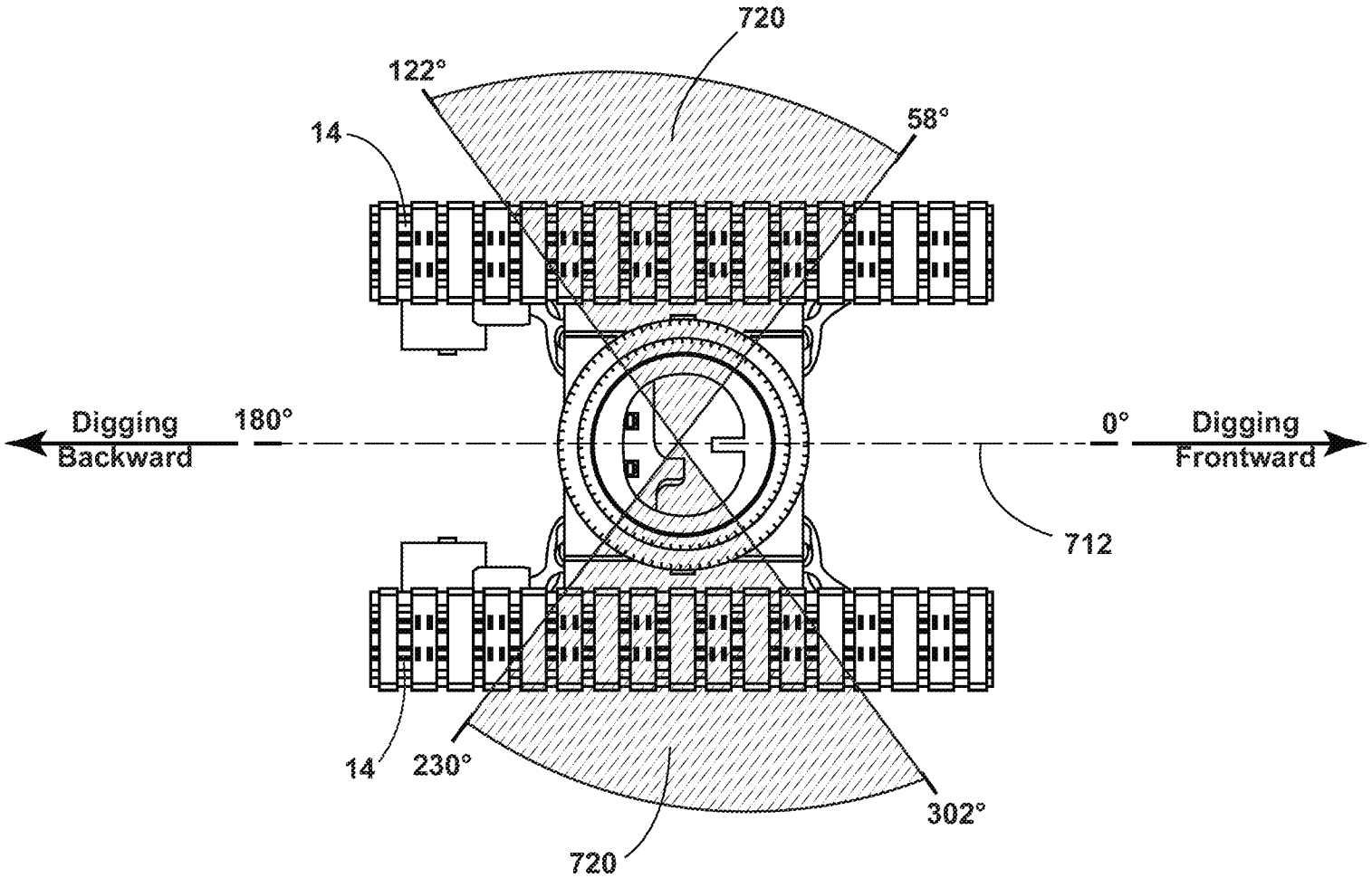
FIG. 14 schematically illustrates a second angle range of the shovel of FIG. 1.

In some embodiments, the controller 80 makes this determination by determining the angle of the boom 30 relative to the crawler shoes 14 as depicted in FIGS. 13 and 14. When the operator is digging with the boom 30 extending over the front of the shovel 10, the angle of the boom 30 falls within a first angle range, and the controller 80 identifies the shovel 10 under Scenario A. When the operator is digging with the boom 30 extending over the side of the shovel 10, the angle of the boom 30 falls within a second angle range, and the controller 80 identifies the shovel 10 under Scenario B. The angle of the boom 30 may be measured relative to an axis 712 defined by the crawler shoes 14, where the axis 712 extends along the length of the crawler shoes 14 toward the front of the shovel 10 (see FIGS. 13 and 14). The angle of the boom 30 can be detected by one or more positional sensors mounted on the shovel 10 that track the swing angle of the shovel 10.

For example, FIG. 13 illustrates a first angle range according to one embodiment of the invention. As illustrated in FIG. 13, the first angle range 715 (see shaded region) includes angles between approximately +58 degrees and approximately −58 degrees (for example, approximately 302 degrees) and between approximately 122 and approximately 238 degrees. Similarly FIG. 14 illustrates a second angle range according to one embodiment of the invention. As illustrated in FIG. 14, the second angle range 720 (see shaded region) includes angles between approximately 58 degrees and approximately 122 degrees and between approximately 238 degrees and approximately 302 degrees.

Returning to FIG. 12, the controller 80 uses the angle of the boom 30 (swing angle) to determine whether the shovel 10 is positioned under Scenario A (over the front) or Scenario B (over the side) (at block 710). The controller 80 also determines the inclination of the surface supporting the shovel 10 (at blocks 730 and 735). In some embodiments, the controller 80 determines the inclination based on readings from one or more inclinometers. For example, the controller 80 can receive measurements from two different inclinometers mounted on the shovel 10 that provide angular slope signals at approximately 90 degrees with respect to each other and can calculate the inclination based on an average of the measurements. Accordingly, in some embodiments, the controller 80 calculates a running inclination based on the inclinometer readings. Alternatively or in addition, the controller 80 can be configured to calculate the inclination indirectly based on operational parameters of the shovel 10, such as ground pressure as described above. Also, it should be understood that, in some embodiments, the controller 80 determines the inclination differently depending on whether the shovel 10 is digging over the front or over the side.

As illustrated in FIG. 12, when the controller 80 has identified the shovel 10 as being in Scenario A, the controller 80 monitors the inclination of the shovel 10 to determine whether the inclination is equal to or exceeds a first predetermined threshold (for example, approximately 15%) (at block 740). In particular, the controller 80 compares the calculated inclination (at block 730) to the first predetermined threshold. In some embodiments, the controller 80 also determines whether the shovel 10 is in a dig mode (at block 750). A dig mode generally occurs after a dig prep mode and before a swing full state. In other words, a dig mode is a shovel state in which the shovel operator has entered a dig cycle and is actively digging through the bank. The controller 80 can check for this condition to ensure that stability control is needed. For example, when the shovel 10 is merely being transported or positioned (but is not actively digging), the controller 80 may not need to worry about limiting control of the shovel 10 to keep the shovel 10 stable.

As illustrated in FIG. 12, when the shovel 10 is under Scenario A (at block 710), is in dig mode (at block 750), and the inclination exceeds the first predetermined threshold (at block 740), the controller 80 reduces the maximum available hoist bail pull, hoist bail speed, or a combination thereof (at block 760). For example, the controller 80 may reduce the maximum available hoist bail pull to 80% and may reduce maximum hoist speed to 10%. In some embodiments, the controller 80 reduces hoist bail pull, hoist bail speed, or both once the inclination exceeds the first predetermined threshold and maintains the reduction until the inclination no longer exceeds the first predetermined threshold. Also, in some embodiments, the controller 80 applies the reduction when the inclination is approaching the first predetermined threshold (for example, within approximately 1% to 5% of the threshold). Furthermore, in some embodiments, the controller 80 prevents all hoist motion of the shovel 10 when the first predetermined threshold is exceeded until the inclination falls below the first predetermined threshold. As illustrated in FIG. 12, the controller 80 can also be configured to generate one or more warnings (for example, audible, visual, tactile, or a combination thereof) when the inclination is approaching or exceeds the first predetermined threshold (at block 770). Also, in some embodiments, the controller 80 generates one or more warnings when the controller 80 limits motion (for example, hoist motion) of the shovel 10 (at block 760).

Alternatively, as illustrated in FIG. 12, when the controller 80 has identified the shovel 10 as being in Scenario B (at block 710), the controller 80 monitors the inclination of the shovel 10 to determine whether the inclination is equal to or exceeds a second predetermined threshold (for example, approximately 6%) (at block 780). In particular, the controller 80 compares the calculated inclination (at block 735) to the second predetermined threshold. As noted above, in some embodiments, the second predetermined threshold is different than (for example, less than) the first predetermined threshold. In some embodiments, the controller 80 also determines whether the shovel 10 is in a dig mode (at block 790). As described above, a dig mode generally occurs after a dig prep mode and before a swing full state. In other words, a dig mode is a shovel state in which the shovel operator has entered a dig cycle and is actively digging through the bank. The controller 80 can check for this condition to ensure that stability control is needed. For example, when the shovel 10 is merely being transported or positioned (but is not actively digging), the controller 80 may not need to worry about limiting control of the shovel 10 to keep the shovel 10 stable.

As illustrated in FIG. 12, when a shovel 10 is under Scenario B (at block 710), is in dig mode (at block 790), and the inclination exceeds the second predetermined threshold (at block 780), the controller 80 reduces the maximum available hoist bail pull, hoist bail speed, or a combination thereof (at block 800). In some embodiments, the controller 80 reduces hoist bail pull, hoist bail speed, or both once the inclination exceeds the second predetermined threshold and maintains the reduction until the inclination no longer exceeds the second predetermined threshold. Also, in some embodiments, the controller 80 applies the reduction when the inclination is approaching the second predetermined threshold (for example, within approximately 1 to 5% of the threshold). Furthermore, in some embodiments, the controller 80 prevents all hoist motion of the shovel 10 when the second predetermined threshold is exceeded until the inclination falls below the second predetermined threshold. Also, in some embodiments, the controller 80 limits hoist motion of the shovel 10 when the inclination exceeds the second predetermined threshold and further limits or prevents hoist motion of the shovel 10 when the inclination exceeds the second predetermined threshold by a particular amount. For example, as noted above, in some embodiments, hoist motion can be limited when the shovel 10 is digging over the side and the inclination exceeds the threshold (for example 6%) to allow the shovel 10 to operate on up to a maximum inclination (for example 15%). However, once the inclination reaches the maximum (for example 15%), the controller 80 can be configured to prevent further hoist motion of the shovel 10. Accordingly, in these situations, the controller 80 executes instructions to reduce the maximum available hoist bail pull, hoist bail speed, or both so that the shovel 10 maintains an acceptable stability on inclinations up to a maximum inclination associated with the shovel 10 (for example, approximately 15%) to match the stability conditions of Scenario A.

In some embodiments, the controller 80 may reduce the hoist bail pull as a function of the angle swing of the boom 30 and the inclination. For example, in some embodiments, the controller 80 applies the following equation to set a maximum hoist force:

$$\text{\% of Max Hoist Force Available} = A^*(\text{Swing Angle})^2 + B^*(\text{Swing Angle}) + C^*(\text{inclination}) + D \qquad \text{Equation (14)}$$

The variables A, B, C, and D can be constants representing parameters of the shovel 10. These variables can be adjusted depending on the circumstances. For example, one or more of the constants can be adjusted when more or less hoist force is desired as a function of swing or the inclination. For example, in some embodiments, when the swing angle is measured in radians, the constant A can have a value between 0 and 1, constant B can have a value between 0 and −4, constant C can have a value between 0 and 4, and constant D can have a value between 0 and 5. Accordingly, the constant C can be increased or decreased to increase or decrease the maximum hoist force. Similarly, the constant A and B can be increased or decreased, respectively, to increase and decrease maximum hoist force relative to the rotational position of the shovel 10.

In some embodiments, the controller 80 limits the maximum available hoist bail pull using Equation 14 when the shovel 10 is in Situation B and the inclination is between the second predetermined threshold and the first predetermined threshold. After the inclination exceeds the first predetermined threshold, the controller 80 can be configured to limit the maximum available hoist bail pull to a set percentage (for example, 80% of maximum).

As illustrated in FIG. 12, the controller 80 can also be configured to generate one or more warnings (for example, audible, visual, tactile, or a combination thereof) when the inclination is approaching or exceeds the second or the first predetermined thresholds (at block 810). Also, in some embodiments, the controller 80 generates one or more warnings when the controller 80 limits motion (for example, hoist motion) of the shovel 10 (at block 800).

It should be understood that the method 700 described above can take into account other operating parameters. For example, in some embodiments, the controller 80 can be configured to take into account a position of the dipper 38 (for example, in x and y coordinates), which allows the controller 80 to vary hoist reduction as a function of the position of the dipper 38. In addition, as noted above, in some embodiments, the controller 80 can be configured to limit hoist motion of the shovel 10 when the inclination approaches a predetermined threshold and prevent all hoist motion when the inclination exceeds the predetermined threshold (for example, approximately 15%).

Figure 15:
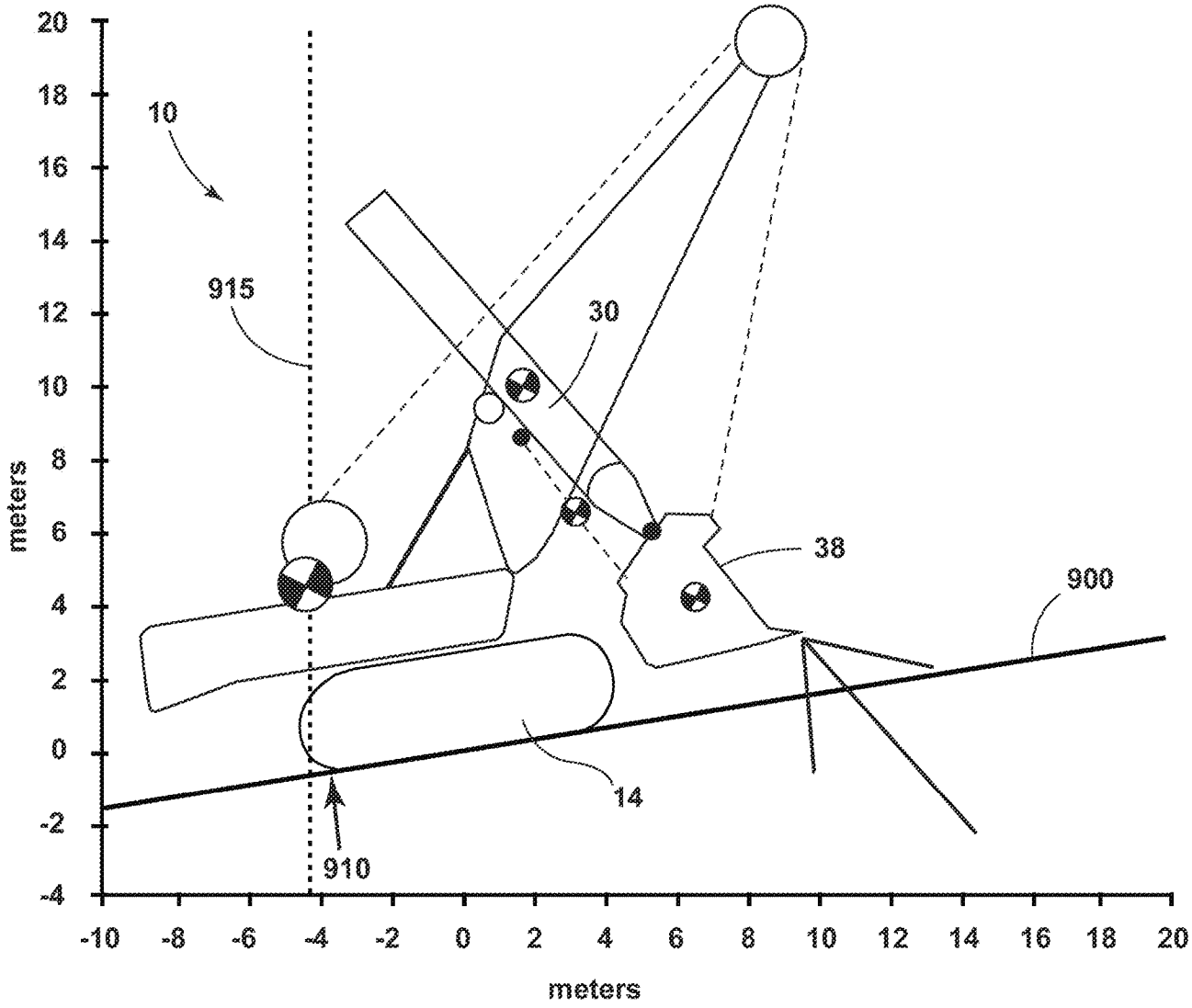
FIGS. 15 and 16 schematically illustrate the shovel of FIG. 1 positioned on an upward inclination.
Figure 16:
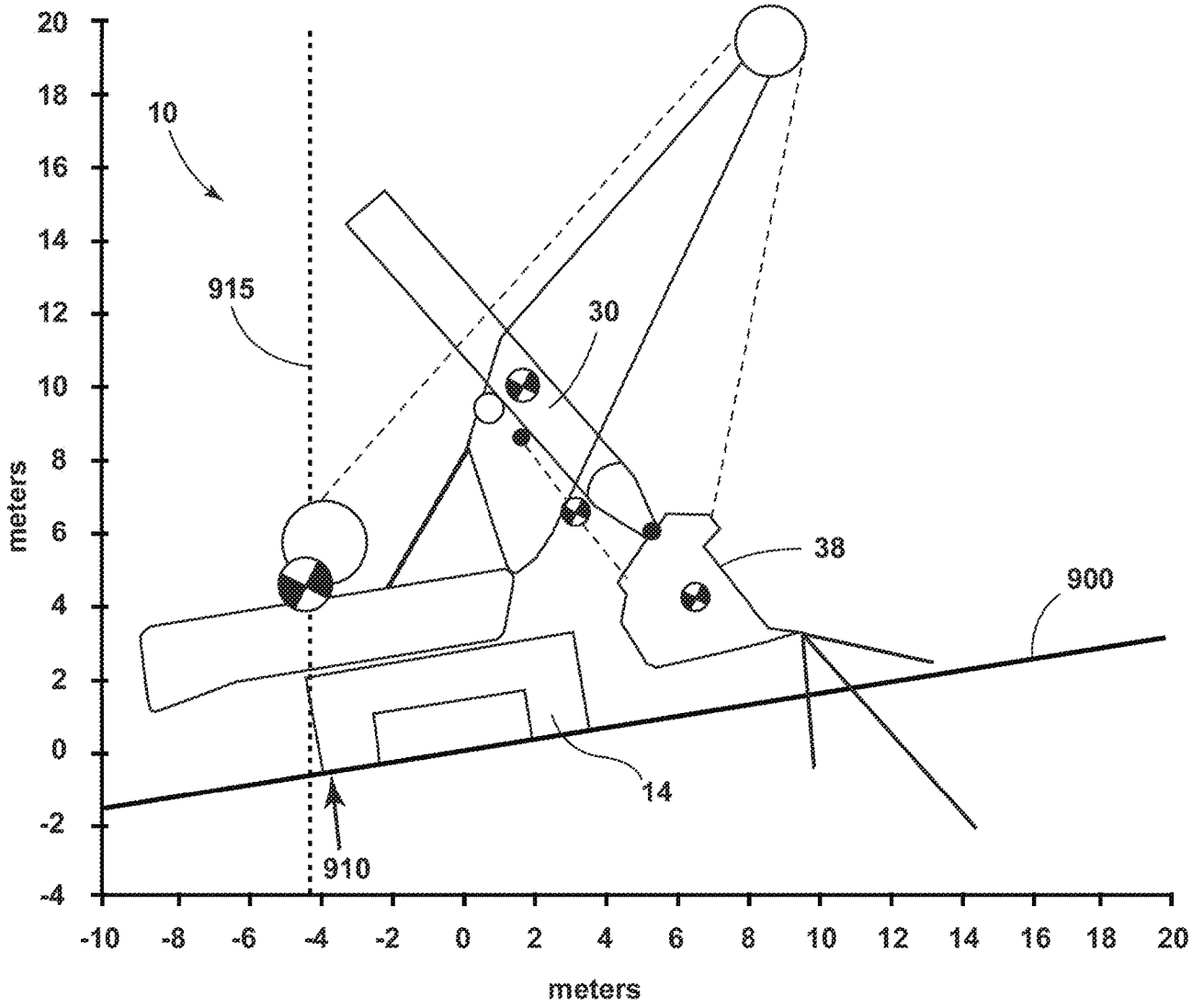

Furthermore, in some embodiments, as an alternative to or in combination with limiting hoist motion, the controller 80 can be configured to control crowd motion of the shovel 10. For example, as illustrated in FIG. 15, when the crawler shoes 14 are parallel to an upward inclination 900, the shovel 10 may tip about a rear tipping location 910 when an eccentricity 915 of the center of gravity of the shovel is not aligned with the rear tipping location 910. In some embodiments, the eccentricity 915 moves when the operator applies a downward extend force to the boom 30. An operator may perform this motion to make it easier to rotate the crawler shoes 14 (sometimes referred to as "crab crawling"). However, this type of motion is not recommended, especially when the shovel 10 is positioned on an upward inclination, since the entire front of the shovel 10 can be lifted into the air and cause undesirable elevated stresses on the shovel components and structures. As illustrated in FIG. 16, a similar situation can occur when the crawler shoes 14 are positioned perpendicular to the upward inclination 900. Accordingly, the controller 80 can be configured to limit (or prevent) crowd motion (for example, downward crowd motion) depending on the inclination of the surface supporting the shovel 10.

Similarly, mining shovels are engineered to move large quantities of material on level surfaces. However, as mining surfaces are rarely flat, mining shovels and other industrial machinery are designed to allow for digging on grades up to a predetermined level based on various characteristics of the machinery and the mining environment (for example, brake characteristics, structural characteristics, and the like). Digging on extreme grades can potentially result in uncontrollable machinery (for example, an uncontrollable dipper), especially when the machinery is overloaded. In particular, digging on extreme grades can cause over-speed shutdowns and collisions with other machinery (for example, a haul truck) due to a delayed stopping response.

Accordingly, in some embodiments, the controller 80 is configured to determine and monitor an inclination (for example, the slope) of the surface supporting the shovel 10 and take one or more actions (for example, automatically modify one or more operating parameters of the shovel 10) in response to the determined inclination. For example, in some embodiments, the controller 80 uses ground pressures, center of gravity, or eccentricity of the center of gravity calculated as described above to determine an inclination of the surface supporting the shovel 10. Alternatively or in addition, the controller 80 can use data from one or more inclinometers installed on the shovel 10 to determine an inclination.

Figure 8:
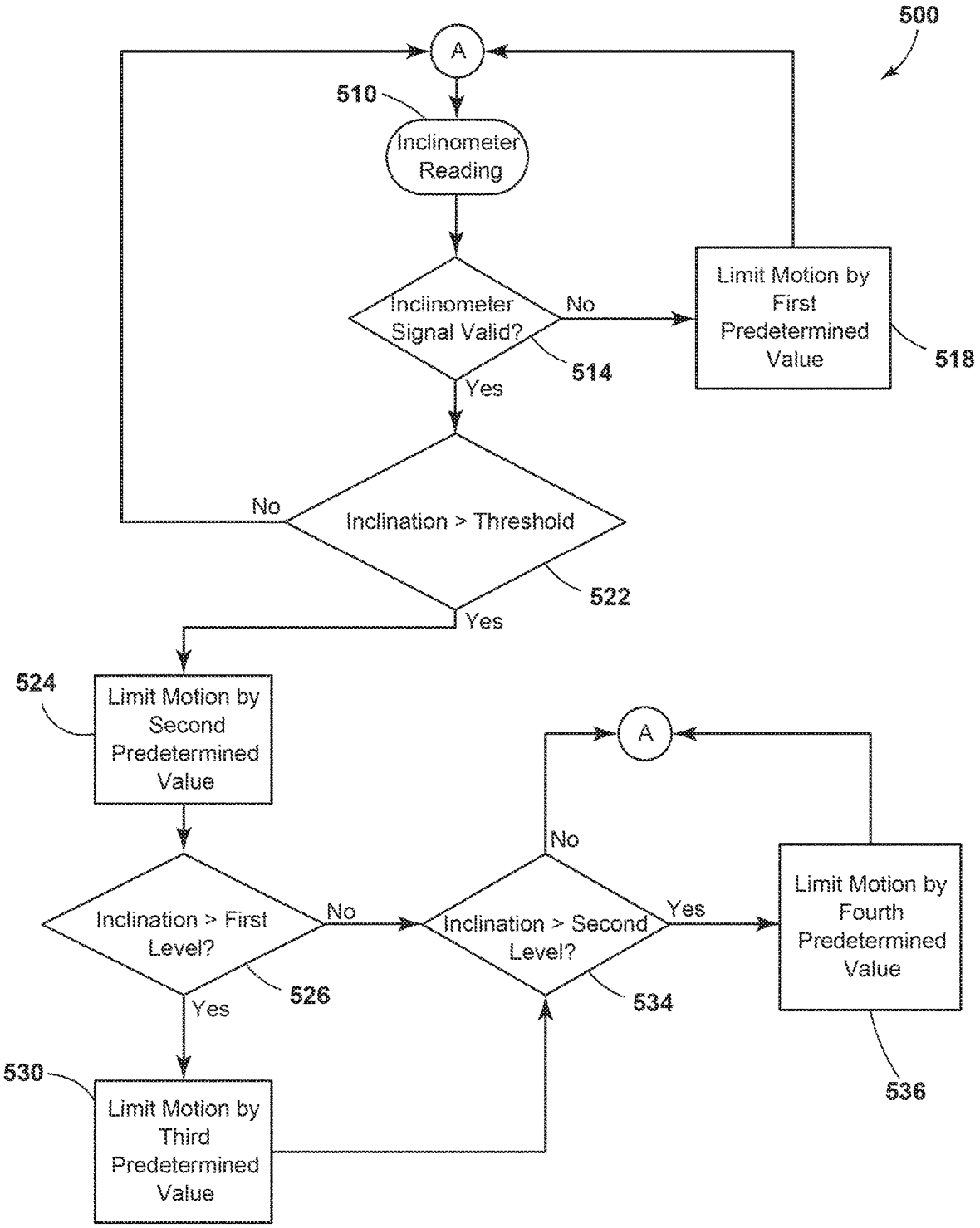
FIG. 8 is a flow chart illustrating a method of controlling the shovel of FIG. 1 based on the inclination of a surface supporting the shovel.

In some embodiments, the controller 80 applies a stepped response to the monitored inclination. For example, FIG. 8 illustrates a method performed by the controller 80 to control the shovel 10 based on the inclination of the surface supporting the shovel 10. As illustrated in FIG. 8, in one embodiment, the controller 80 receives a signal from one or more inclinometers mounted on the shovel 10 (at block 510). The controller 80 determines whether the inclinometer signal is valid (for example, whether a valid signal was provided or whether an error occurred) (at block 514). For example, when the shovel 10 includes two inclinometers but the controller 80 only receives a reading from one inclinometer, the controller 80 may determine that an error has occurred. Similarly, when no signal is received from an inclinometer, the controller 80 may determine that an error has occurred. In some embodiments, when the controller 80 determines that an inclinometer signal is invalid (at block 514), the controller 80 limits motion of the shovel 10 (for example, in at least one direction or mode) to a first predetermined value (at block 518). For example, in some embodiments, the controller 80 limits the swing speed of the boom 30 to the first predetermined value (at block 518). In some embodiments, the first predetermined value is a percentage of a maximum value, such as maximum speed, maximum torque, and the like. For example, in some embodiments, the first predetermined value is approximately 75% to 90%, which means that the controller 80 limits motion of the shovel 10 (for example, swing speed) to approximately 75% to 90% of a maximum amount (for example, a maximum swing speed).

When the controller 80 determines that the inclinometer signal is valid (at block 514), the controller 80 determines one or more inclinations based on the inclinometer signal and determines when the one or more inclinations exceed one or more thresholds (at block 522). For example, in some embodiments, the controller 80 determines when a front/back inclination, a left/right inclination, or a resultant inclination based on the inclinometer signal. The front/back inclination specifies an inclination measured from the front of the shovel 10 (for example, the position of the dipper 38) to the back of the shovel 10. Similarly, left/right inclination specifies an inclination measured from the left of the shovel 10 (for example, from the point of view of an operator located in the cab 26) to the right of the shovel 10. The resultant inclination combines the front/back inclination and the left/right inclination.

When one or more of these inclinations exceeds one or more thresholds (at block 522), the controller 80 limits motion of the shovel 10 (for example, in at least one direction) to a second predetermined value (at block 524). In some embodiments, the controller 80 compares each of these inclinations to the same threshold. In other embodiments, the controller 80 compares one or more of these inclinations to different thresholds. In one embodiment, the threshold is a threshold range, for example, from 5% to 8%.

In some embodiments, the controller 80 limits the motion of the shovel 10 to the second predetermined value by limiting the swing speed of the shovel 10 to the second predetermined value. Limiting the motion of the shovel 10 to the second predetermined value allows the shovel 10 to overcome swing inertia and stop the shovel 10 properly (for example, within a certain amount of time).

In some embodiments, the second predetermined value is less than the first predetermined value. In other embodiments, the second predetermined value is the same as the first predetermined value. As noted above with respect to the first predetermined value, in some embodiments, the second predetermined value is a percentage of a maximum amount of motion or speed of the shovel 10 (for example, a maximum swing speed of the shovel 10).

Also, as illustrated in FIG. 8, when any or all of the determined inclinations exceed a first level (for example, greater than the predetermined threshold(s) applied at block 522) (at block 526), the controller 80 limits motion of the shovel 10 (for example, in at least one direction) to a third predetermined value (at block 530). For example, in some embodiments, the controller 80 limits multiple motions of the shovel 10 (for example, hoist, crowd, swing, propulsion, or a combination thereof) when any or all of the determined inclinations exceed the first level. Alternatively or in addition, the controller 80 may limit the speed swing of the shovel 10 to the third predetermined value. In some embodiments, when the controller 80 limits multiple motions of the shovel 10, the controller 80 is configured to limit each motion differently (by different values). In other embodiments, the controller 80 is configured to limit each motion by the same value. Also, in some embodiments, the third predetermined value is different (for example, less) than the second predetermined value. In other embodiments, the third predetermined value is the same as the second predetermined value (for example, but is applied to more motions than the second predetermined value). Again, as noted above with respect to the first and second predetermined values, in some embodiments, the third predetermined value is a percentage of a maximum amount of motion or speed of the shovel 10 (for example, a maximum swing speed of the shovel 10).

Similarly, when any or all of the determined inclinations exceed a second level (for example, greater than the first level) (at block 534), the controller 80 limits motion of the shovel 10 (for example, in at least one direction) to a fourth predetermined value (at block 536). For example, in some embodiments, the controller 80 limits multiple motions of the shovel 10 (for example, hoist, crowd, swing, propulsion, or a combination thereof) when any or all of the determined inclinations exceed the second level. In some embodiments, when the controller 80 limits multiple motions of the shovel 10, the controller 80 is configured to limit each motion differently (by different values). In other embodiments, the controller 80 is configured to limit each motion by the same value. Also, in some embodiments, the fourth predetermined value is different (for example, less) than the third predetermined value. In other embodiments, the fourth predetermined value is the same as the third predetermined value (for example, but is applied to more motions than the second predetermined value). Again, as noted above with respect to the first, second, and third predetermined values, in some embodiments, the fourth predetermined value is a percentage of a maximum amount of motion or speed of the shovel 10 (for example, a maximum swing speed of the shovel 10).

For example, in some embodiments, the fourth predetermined value is sufficiently low enough to allow the shovel 10 to remove itself from the event in a controlled and safe manner.

Accordingly, the first and second levels allows a stepped approach to handing inclines, wherein different adjustments can be made based on the actual incline (for example, as compared to applying the same adjustment whenever the incline exceeds a predetermined threshold). For example, in some embodiments, the threshold (used at block 522) may represent a minimum incline at which added control may be useful and the first and second levels may represent inclines greater than the minimum incline that are used to handle more extreme inclines. The levels (as well as the threshold) may also be configurable to allow the functionality illustrated in FIG. 8 to be used with various types of machinery operating in various environments.

As illustrated in FIG. 8, the controller 80 can repeat the method 500 and obtain new inclinometer readings to determine and monitor the current inclination of the surface supporting the shovel 10. It should be understood that in some embodiments in addition to or as an alternative to obtaining inclinometer readings, the controller 80 can be configured to determine an inclination indirectly using operational parameters of the shovel 10. For example, in some embodiments, the controller 80 can use ground pressures, as calculated above, to determine an inclination (for example, when shovel 10 is in a predetermined state, such as an unloaded state). It should also be understood that the controller 80 can be configured to generate one or more warnings (for example, audible, visual, tactile, or a combination thereof) to alert an operator or other personnel when motion of the shovel 10 is being limited (and, optionally, when such limits are removed).

Thus, embodiments of the invention provide, among other things, systems and methods for limiting motion of an industrial machine, such as a mining shovel. These systems and methods can be used to lower the risk of an industrial machine tipping over during operation. The systems and methods can also be used to control ground pressure to lower component stresses and revolve frame stress. For example, by controlling and monitoring the eccentricity of the machines center of gravity and inclination machine parameters can be adjusted to prevent uncontrolled motion. Also, the systems and methods provide an opportunity to reduce overall shoe machine weight and cost by controlling extreme load cases.

Various features of the invention are set forth in the following claims.

What is claimed is:

1. A method of operating an industrial machine, the method comprising:

calculating, with an electronic processor, an eccentricity of a center of gravity of the industrial machine; and limiting, with the electronic processor, a maximum torque applied by at least one selected from the group consisting of a hoist actuator and a crowd actuator included in the industrial machine to less than an available maximum torque based on the eccentricity of the center of gravity, wherein calculating the eccentricity of the center of gravity of the industrial machine includes calculating a distance between the center of gravity of the industrial machine and a center of a bearing associated with at least one crawler shoe included in the industrial machine.

2. The method of claim 1, further comprising calculating a ground pressure associated with the industrial machine based on the eccentricity of the center of gravity.

3. The method of claim 2, wherein calculating the ground pressure associated with the industrial machine based on the eccentricity of the center of gravity includes comparing the eccentricity of the center of gravity to a predetermined ratio of a length of a bearing associated with at least one crawler shoe of the industrial machine, calculating the ground pressure associated with the industrial machine using a first equation when the eccentricity of the center of gravity is equal to or less than the predetermined ratio, and calculating the ground pressure associated with the industrial machine using a second equation when the eccentricity of the center of gravity is greater than the predetermined ratio.

4. The method of claim 2, wherein calculating the ground pressure associated with the industrial machine includes calculating a pressure based on a weight of the industrial machine, a length of one or more crawler shoes included in the industrial machine, and a length of a bearing associated with the one or more crawler shoes.

5. The method of claim 2, wherein calculating the ground pressure includes calculating a maximum ground pressure based on the eccentricity of the center of gravity and wherein limiting the maximum torque includes comparing the maximum ground pressure to a threshold and limiting the maximum torque when the maximum ground pressure is greater than the threshold.

6. The method of claim 2, wherein calculating the ground pressure includes calculating a minimum ground pressure based on the eccentricity of the center of gravity and wherein limiting the maximum torque includes limiting the maximum torque when the minimum ground pressure is less than zero.

7. The method of claim 1, wherein limiting the maximum torque includes setting the maximum torque to a predetermined percentage of the available maximum torque.

8. The method of claim 1, wherein limiting the maximum torque includes setting the maximum torque to a percentage of the available maximum torque, wherein the percentage is based on at least one selected from the group consisting of a ground pressure and the eccentricity of the center of gravity.

9. The method of claim 1, wherein limiting the maximum torque includes setting the maximum torque to between 80% to and 90% of the available maximum torque.

10. The method of claim 1, wherein limiting the maximum torque includes limiting the maximum torque when the eccentricity of the center of gravity is greater than a predetermined percentage of a length of a bearing associated with at least one crawler shoe included in the industrial machine.

11. A system for operating an industrial machine, the system comprising:

a controller including an electronic processor, the electronic processor configured to calculate an eccentricity of a center of gravity of the industrial machine with respect to a center of a bearing propelling the industrial machine, calculate a ground pressure associated with the bearing based on the eccentricity of the center of gravity, and set a maximum torque applied by an actuator included in the industrial machine to a value less than an available maximum torque based on the eccentricity of the center of gravity and the ground pressure.

12. The system of claim 11, wherein the electronic processor is configured to set the maximum torque applied by the actuator to at least one selected from the group comprising a predetermined percentage of the available maximum torque and a percentage of the available maximum torque based on the ground pressure.

13. The system of claim 11, wherein the actuator applies at least one selected from the group consisting of hoist torque and crowd torque and wherein the actuator applies torque to a dipper included in the industrial machine.

14. The system of claim 11, wherein the electronic processor is configured to set the maximum torque applied by the actuator to the value less than the available maximum torque when the ground pressure is greater than a predetermined threshold.

15. The system of claim 11, wherein the electronic processor is configured to set the maximum torque applied by the actuator to the value less than the available maximum torque when the ground pressure is less than zero.

16. The system of claim 11, wherein the electronic processor is configured to set the maximum torque applied by the actuator to the value less than the available maximum torque when the eccentricity of the center of gravity is greater than a predetermined percentage of a length of the bearing.

17. A system for operating an industrial machine, the system comprising:

an inclinometer configured to sense an incline of the industrial machine; and a controller including an electronic processor, the electronic processor configured to determine a position of the industrial machine, receive an inclination of the industrial machine from the inclinometer, compare the inclination of the industrial machine to a first level, when the inclination exceeds the first level, limit motion of the industrial machine to a first predetermined value by setting a maximum torque applied by an actuator configured to apply a torque to a dipper included in the industrial machine to a value less than an available maximum torque, wherein the first predetermined value is based on the position of the industrial machine, compare the inclination of the industrial machine to a second level, and when the inclination exceeds the second level, limit motion of the industrial machine to a second predetermined value.

18. The system of claim 17, wherein the electronic processor is further configured to determine whether the industrial machine is digging over a front of the industrial machine or a side of the industrial machine, determine an inclination of the industrial machine, when the industrial machine is digging over the front of the industrial machine, compare the inclination of the industrial machine to a first threshold, and when the inclination of the industrial machine exceeds the first threshold, limit movement of the industrial machine, and when the industrial machine is digging over the side of the industrial machine, compare the inclination of the industrial machine to a second threshold, and when the inclination of the industrial machine exceeds the second threshold, limit movement of the industrial machine.

19. The system of claim 17, wherein the first predetermined value is further based on the inclination of the industrial machine.

20. A system for operating an industrial machine, the system comprising:

a controller including an electronic processor, the electronic processor configured to determine a position of the industrial machine, wherein determining the position of the industrial machine includes determining whether the industrial machine is digging over a front of the industrial machine or a side of the industrial machine, and set a maximum hoist torque applied by an actuator configured to apply a hoist torque to a dipper included in the industrial machine to a value less than an available maximum hoist torque based on the position of the industrial machine, wherein the maximum hoist torque is based on the position of the industrial machine.

21. The system of claim 20, wherein the electronic processor is further configured to determine an inclination of the industrial machine, when the industrial machine is digging over the front of the industrial machine, compare the inclination of the industrial machine to a first threshold, and when the inclination of the industrial machine exceeds the first threshold, limit movement of the industrial machine, and when the industrial machine is digging over the side of the industrial machine, compare the inclination of the industrial machine to a second threshold, and when the inclination of the industrial machine exceeds the second threshold, limit movement of the industrial machine.

* * * * *